US008905735B2

(12) United States Patent
Holtzapple et al.

(10) Patent No.: US 8,905,735 B2
(45) **Date of Patent: *Dec. 9, 2014**

(54) GEROTOR APPARATUS FOR A QUASI-ISOTHERMAL BRAYTON CYCLE ENGINE

(75) Inventors: Mark T. Holtzapple, College Station, TX (US); Andrew Rabroker, College Station, TX (US); Michael Kyle Ross, Bryan, TX (US); Steven D. Atmur, Clifton Park, NY (US); Gary P. Noyes, Houston, TX (US)

(73) Assignees: The Texas A&M University System, College Station, TX (US); StarRotor Corportion, College Station, TX (US)

( * ) Notice: Subject to any disclaimer, the term of this patent is extended or adjusted under 35 U.S.C. 154(b) by 150 days.

This patent is subject to a terminal disclaimer.

(21) Appl. No.: 12/749,032

(22) Filed: Mar. 29, 2010

(65) Prior Publication Data

US 2010/0247360 A1 Sep. 30, 2010

Related U.S. Application Data

(63) Continuation of application No. 11/256,364, filed on Oct. 21, 2005, now Pat. No. 7,695,260.

(60) Provisional application No. 60/621,221, filed on Oct. 22, 2004.

(51) Int. Cl.

| | |
|---|---|
| ***F01C 19/00*** | (2006.01) |
| ***F03C 2/00*** | (2006.01) |
| ***F01C 19/02*** | (2006.01) |
| ***F01C 21/06*** | (2006.01) |
| ***F01C 20/14*** | (2006.01) |
| ***F01C 1/10*** | (2006.01) |

(52) U.S. Cl.

CPC ..... *F01C 1/103* (2013.01); *F01C 19/02* (2013.01); *F01C 21/06* (2013.01); *F01C 20/14* (2013.01)

USPC ..... 418/104; 418/19; 418/171; 418/190

(58) Field of Classification Search

USPC ..... 418/104, 140, 142, 166–171, 189, 190, 418/61.3, 178, 152, 19, 21, 26

See application file for complete search history.

(56) References Cited

U.S. PATENT DOCUMENTS

| | | | |
|---|---|---|---|
| 457,294 | A | 8/1891 | Tilden |
| 724,665 | A | 4/1903 | Cooley |

(Continued)

FOREIGN PATENT DOCUMENTS

| | | |
|---|---|---|
| AU | 20406/29 | 0/1929 |
| DE | 35 13 348 | 10/1986 |

(Continued)

OTHER PUBLICATIONS

PCT Notification of Transmittal of The International Search Report and The Written Opinion of the International Searching Authority, or the Declaration, PCT/US/06/14613, dated Aug. 16, 2007; (10 pages).

(Continued)

*Primary Examiner* — Theresa Trieu

(57) ABSTRACT

According to one embodiment of the invention, an engine system comprises a housing, an outer gerotor, an inner gerotor, a tip inlet port, a face inlet port, and a tip outlet port. The housing has a first sidewall, a second sidewall, a first endwall, and a second endwall. The outer gerotor is at least partially disposed in the housing and at least partially defines an outer gerotor chamber. The inner gerotor is at least partially disposed within the outer gerotor chamber. The tip inlet port is formed in the first sidewall and allows fluid to enter the outer gerotor chamber. The face inlet port is formed in the first endwall and allows fluid to enter the outer gerotor chamber. The tip outlet port is formed in the second sidewall and allows fluid to exit the outer gerotor chamber.

28 Claims, 24 Drawing Sheets

(56) References Cited

U.S. PATENT DOCUMENTS

| | | | | |
|---|---|---|---|---|
| 892,295 | A | | 6/1908 | Nutz |
| 1,501,051 | A | | 7/1924 | Hill |
| 1,854,692 | A | | 4/1932 | Cooper |
| 2,011,338 | A | | 8/1935 | Hill |
| 2,138,490 | A | | 11/1938 | Haller |
| 2,240,056 | A | | 4/1941 | Schmitz |
| 2,291,354 | A | | 7/1942 | Sibley |
| 2,373,368 | A | | 4/1945 | Witchger |
| 2,459,447 | A | | 1/1949 | Milliken |
| 2,601,397 | A | | 6/1952 | Hill et al. |
| 2,938,663 | A | | 5/1960 | Lück |
| 2,965,039 | A | | 12/1960 | Morita |
| 2,974,482 | A | | 3/1961 | Kelley |
| 3,037,348 | A | | 6/1962 | Gassmann |
| 3,167,913 | A | | 2/1965 | Mühlberg et al. |
| 3,214,087 | A | | 10/1965 | Lück |
| 3,226,013 | A | | 12/1965 | Schoichiro et al. |
| 3,233,524 | A | | 2/1966 | Charlson |
| 3,273,341 | A | | 9/1966 | Wildhaber |
| 3,295,748 | A | | 1/1967 | Leitgeb |
| 3,303,783 | A | | 2/1967 | Neubauer |
| 3,303,784 | A | | 2/1967 | Neubauer |
| 3,334,253 | A | | 8/1967 | Hill |
| 3,525,580 | A | * | 8/1970 | Eckerle ..... 418/169 |
| 3,536,426 | A | | 10/1970 | Albretch et al. |
| 3,623,317 | A | | 11/1971 | Foster-Pegg |
| 3,657,879 | A | | 4/1972 | Ewbank et al. |
| 3,844,117 | A | | 10/1974 | Ryan |
| 3,846,987 | A | | 11/1974 | Baldwin |
| 3,877,218 | A | | 4/1975 | Negben |
| 3,894,255 | A | | 7/1975 | Newton, Jr. |
| 3,928,974 | A | | 12/1975 | Benson |
| 3,932,987 | A | | 1/1976 | Munzinger |
| 3,972,652 | A | | 8/1976 | Minnicino |
| 3,995,431 | A | | 12/1976 | Schwartzman |
| 4,023,366 | A | | 5/1977 | Schneider |
| 4,028,023 | A | | 6/1977 | Labus |
| 4,044,558 | A | | 8/1977 | Benson |
| 4,052,928 | A | | 10/1977 | Pierrat et al. |
| 4,058,938 | A | | 11/1977 | Harle et al. |
| 4,074,533 | A | | 2/1978 | Stockton |
| 4,127,364 | A | | 11/1978 | Eiermann et al. |
| 4,145,167 | A | | 3/1979 | Baatrup |
| 4,179,890 | A | | 12/1979 | Hanson |
| 4,199,305 | A | | 4/1980 | Pareja |
| 4,336,686 | A | | 6/1982 | Porter |
| 4,355,249 | A | | 10/1982 | Kenwell |
| 4,392,797 | A | | 7/1983 | Ruf |
| 4,439,119 | A | | 3/1984 | Petersen et al. |
| 4,457,677 | A | | 7/1984 | Todd |
| 4,478,553 | A | | 10/1984 | Leibowitz et al. |
| 4,491,171 | A | | 1/1985 | Zenkner |
| 4,502,284 | A | | 3/1985 | Chrisoghilos |
| 4,519,206 | A | | 5/1985 | van Michaels |
| 4,553,513 | A | | 11/1985 | Miles et al. |
| 4,578,955 | A | | 4/1986 | Medina |
| 4,630,447 | A | | 12/1986 | Webber |
| 4,653,269 | A | | 3/1987 | Johnson |
| 4,657,009 | A | | 4/1987 | Zen |
| 4,674,960 | A | | 6/1987 | Rando et al. |
| 4,696,158 | A | | 9/1987 | DeFrancisco |
| 4,759,178 | A | | 7/1988 | Joy |
| 4,775,299 | A | | 10/1988 | Overfield et al. |
| 4,801,255 | A | | 1/1989 | Wankel |
| 4,836,760 | A | | 6/1989 | MacLeod |
| 4,940,394 | A | | 7/1990 | Gibbons |
| 4,951,790 | A | | 8/1990 | Blything |
| 4,958,997 | A | | 9/1990 | Harwath |
| 4,968,233 | A | | 11/1990 | Nakayoshi et al. |
| 4,976,595 | A | | 12/1990 | Taniguchi |
| 4,986,739 | A | | 1/1991 | Child |
| 5,044,907 | A | | 9/1991 | Hirosawa et al. |
| 5,074,110 | A | | 12/1991 | Singh |
| 5,101,782 | A | | 4/1992 | Yang |
| 5,195,882 | A | | 3/1993 | Freeman |
| 5,271,215 | A | | 12/1993 | Guillet |
| 5,284,016 | A | | 2/1994 | Stark |
| 5,289,072 | A | | 2/1994 | Lange |
| 5,311,739 | A | | 5/1994 | Clark |
| 5,472,329 | A | | 12/1995 | Maynard et al. |
| 5,522,356 | A | | 6/1996 | Palmer |
| 5,538,073 | A | | 7/1996 | Stopa |
| 5,554,020 | A | | 9/1996 | Rao et al. |
| 5,557,921 | A | | 9/1996 | Frutschi et al. |
| 5,618,171 | A | | 4/1997 | von Behr et al. |
| 5,622,044 | A | | 4/1997 | Bronicki et al. |
| 5,634,339 | A | | 6/1997 | Lewis et al. |
| 5,682,738 | A | | 11/1997 | Barber |
| 5,733,111 | A | | 3/1998 | Yu et al. |
| 5,755,196 | A | | 5/1998 | Klassen |
| 5,761,898 | A | | 6/1998 | Barnes et al. |
| 5,769,619 | A | | 6/1998 | Crevelin et al. |
| 5,798,591 | A | | 8/1998 | Lillington et al. |
| 5,839,270 | A | | 11/1998 | Jirnov et al. |
| 5,854,526 | A | | 12/1998 | Sakamoto |
| 5,964,087 | A | | 10/1999 | Tort-Oropeza |
| 6,085,829 | A | | 7/2000 | Neuhaus et al. |
| 6,126,420 | A | * | 10/2000 | Eisenmann ..... 418/19 |
| 6,174,151 | B1 | | 1/2001 | Yarr |
| 6,206,296 | B1 | | 3/2001 | Suzuki et al. |
| 6,313,544 | B1 | | 11/2001 | Mongia et al. |
| 6,336,317 | B1 | | 1/2002 | Holtzapple et al. |
| 6,427,453 | B1 | | 8/2002 | Holtzapple et al. |
| 6,487,862 | B1 | | 12/2002 | Doorley |
| 6,530,211 | B2 | | 3/2003 | Holtzapple et al. |
| 6,886,326 | B2 | | 5/2005 | Holtzapple et al. |
| 7,008,200 | B2 | | 3/2006 | Holtzapple et al. |
| 7,186,101 | B2 | | 3/2007 | Holtzapple et al. |
| 2003/0011268 | A1 | | 1/2003 | Even et al. |

FOREIGN PATENT DOCUMENTS

| | | | |
|---|---|---|---|
| DE | 3812637 | | 7/1989 |
| DE | 40 23 299 | | 2/1991 |
| DE | 197 20 048 | A1 | 11/1998 |
| EP | 02-207187 | | 8/1990 |
| EP | 1 197 634 | | 4/2002 |
| FR | 2720788 | | 9/1996 |
| FR | 2 812 041 | A1 | 1/2002 |
| GB | 2 085 969 | | 5/1982 |
| GB | 2 221 258 | | 1/1990 |
| JP | 0402-207187 | | 8/1990 |
| JP | 405001674 | | 1/1993 |
| JP | 405079464 | | 3/1993 |
| JP | 06-330875 | | 11/1994 |
| WO | WO 97/48884 | | 12/1997 |
| WO | WO 03/067030 | A2 | 8/2003 |

OTHER PUBLICATIONS

PCT Written Opinion for International Application No. PCT/US03/03549: filed Feb. 5, 2003: (12 pages), Sep. 24, 2004.
EP Communication for Application No. 03737665.4; Apr. 5, 2007; Reference No. JL4578; (6 pages).
Declaration of Mark Holtzapple, dated May 10, 2005, 6 pages.
Declaration of Mark Holtzapple, dated Apr. 29, 2005, 6 pages.
English Translation of Office Action from Japan Patent Office; (4 pages), Oct. 19, 2010.

* cited by examiner

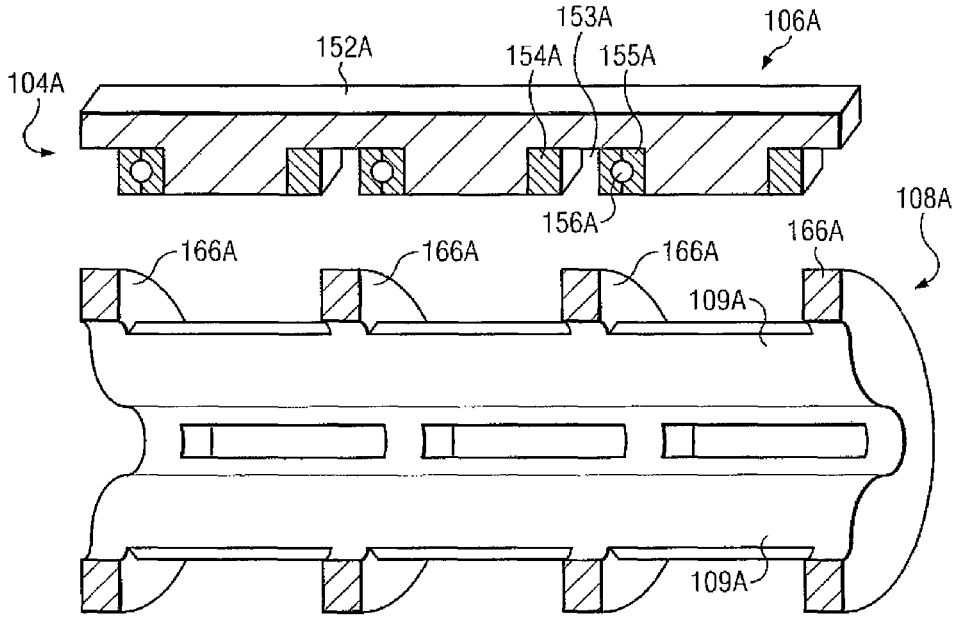
FIG. 3
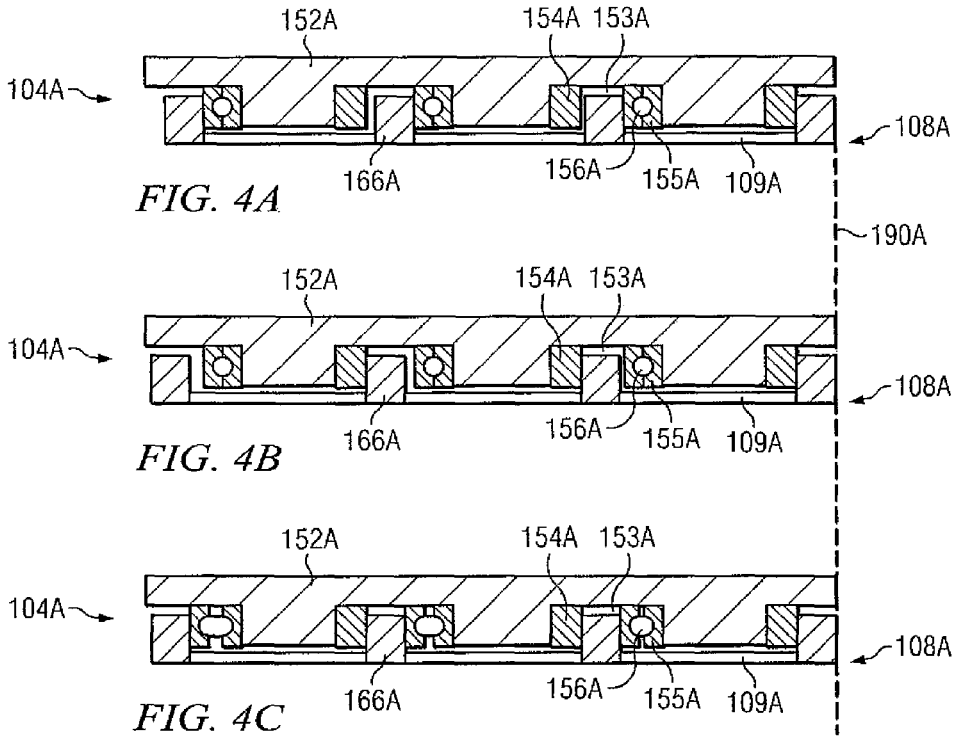
FIG. 4A
FIG. 4B
FIG. 4C

GEROTOR APPARATUS FOR A QUASI-ISOTHERMAL BRAYTON CYCLE ENGINE

RELATED APPLICATIONS

This application is a continuation of U.S. application Ser. No. 11/256,364 filed Oct. 21, 2005 and entitled "Gerotor Apparatus for a Quasi-Isothermal Brayton Cycle Engine," which claims benefit under 35 U.S.C. §119(e) of U.S. Provisional Application Ser. No. 60/621,221, entitled "Quasi-Isothermal Brayton Cycle Engine," filed on Oct. 22, 2004.

TECHNICAL FIELD OF THE INVENTION

The present invention relates to a gerotor apparatus that functions as a compressor or expander. The gerotor apparatus may be applied generally to Brayton cycle engines and, more particularly, to a quasi-isothermal Brayton cycle engine.

BACKGROUND OF THE INVENTION

For mobile applications, such as an automobile or truck, it is generally desirable to use a heat engine that has the following characteristics: internal combustion to reduce the need for heat exchangers; complete expansion for improved efficiency; isothermal compression and expansion; high power density; high-temperature expansion for high efficiency; ability to efficiently "throttle" the engine for part-load conditions; high turn-down ratio (i.e., the ability to operate at widely ranging speeds and torques); low pollution; uses standard components with which the automotive industry is familiar; multifuel capability; and regenerative braking. There are currently several types of heat engines, each with their own characteristics and cycles. These heat engines include the Otto Cycle engine, the Diesel Cycle engine, the Rankine Cycle engine, the Stirling Cycle engine, the Erickson Cycle engine, the Carnot Cycle engine, and the Brayton Cycle engine. A brief description of each engine is provided below.

The Otto Cycle engine is an inexpensive, internal combustion, low-compression engine with a fairly low efficiency. This engine is widely used to power automobiles.

The Diesel Cycle engine is a moderately expensive, internal combustion, high-compression engine with a high efficiency that is widely used to power trucks and trains.

The Rankine Cycle engine is an external combustion engine that is generally used in electric power plants. Water is the most common working fluid.

The Erickson Cycle engine uses isothermal compression and expansion with constant-pressure heat transfer. It may be implemented as either an external or internal combustion cycle. In practice, a perfect Erickson cycle is difficult to achieve because isothermal expansion and compression are not readily attained in large, industrial equipment.

The Carnot Cycle engine uses isothermal compression and expansion and adiabatic compression and expansion. The Carnot Cycle may be implemented as either an external or internal combustion cycle. It features low power density, mechanical complexity, and difficult-to-achieve constant-temperature compressor and expander.

The Stirling Cycle engine uses isothermal compression and expansion with constant-volume heat transfer. It is almost always implemented as an external combustion cycle. It has a higher power density than the Carnot cycle, but it is difficult to perform the heat exchange, and it is difficult to achieve constant-temperature compression and expansion.

The Stirling, Erickson, and Carnot cycles are as efficient as nature allows because heat is delivered at a uniformly high temperature, $T_{hot}$, during the isothermal expansion, and rejected at a uniformly low temperature, $T_{cold}$, during the isothermal compression. The maximum efficiency, of these three cycles is:

$$\eta_{max} = 1 - \frac{T_{cold}}{T_{hot}}$$

This efficiency is attainable only if the engine is "reversible," meaning that the engine is frictionless, and that there are no temperature or pressure gradients. In practice, real engines have "irreversibilities," or losses, associated with friction and temperature/pressure gradients.

The Brayton Cycle engine is an internal combustion engine that is generally implemented with turbines and is generally used to power aircraft and some electric power plants. The Brayton cycle features very high power density, normally does not use a heat exchanger, and has a lower efficiency than the other cycles. When a regenerator is added to the Brayton cycle, however, the cycle efficiency increases. Traditionally, the Brayton cycle is implemented using axial-flow, multi-stage compressors and expanders. These devices are generally suitable for aviation in which aircraft operate at fairly constant speeds; they are generally not suitable for most transportation applications, such as automobiles, buses, trucks, and trains, which must operate over widely varying speeds.

The Otto cycle, the Diesel cycle, the Brayton cycle, and the Rankine cycle all have efficiencies less than the maximum because they do not use isothermal compression and expansion steps. Further, the Otto and Diesel cycle engines lose efficiency because they do not completely expand high-pressure gases, and simply throttle the waste gases to the atmosphere.

Reducing the size and complexity, as well as the cost, of Brayton cycle engines is important. In addition, improving the efficiency of Brayton cycle engines and/or their components is important. Manufacturers of Brayton cycle engines are continually searching for better and more economical ways of producing Brayton cycle engines.

SUMMARY OF THE INVENTION

According to one embodiment of the invention, an engine system comprises a housing, an outer gerotor, an inner gerotor, a tip inlet port, a face inlet port, and a tip outlet port. The housing has a first sidewall, a second sidewall, a first endwall, and a second endwall. The outer gerotor is at least partially disposed in the housing and at least partially defines an outer gerotor chamber. The inner gerotor is at least partially disposed within the outer gerotor chamber. The tip inlet port is formed in the first sidewall and allows fluid to enter the outer gerotor chamber. The face inlet port is formed in the first endwall and allows fluid to enter the outer gerotor chamber. The tip outlet port is formed in the second sidewall and allows fluid to exit the outer gerotor chamber.

Certain embodiments of the invention may provide numerous technical advantages. For example, a technical advantage of one embodiment may include the capability to enhance fluid intake into an outer chamber. Other technical advantages of other embodiments may include the capability to reduce dead volume in an engine system. Yet other technical advantages of other embodiments may include the capability to allow selective passage of fluid through a face inlet port. Still yet other technical advantages of other embodiments may include the capability to manipulate and/or regulate temperature in a housing. Still yet other technical advantages of other embodiments may include the capability to abrade tips of an outer gerotor. Still yet other technical advantages of other embodiments may include the capability to adjust a compression or expansion ratio in an outer gerotor chamber. Still yet other technical advantages of other embodiments may include the capability to create symmetries in ports to balance pressures developed by leaks. Still yet other technical advantages of other embodiments may include the capability to move a thermal datum into substantially the same plane as a seal between a housing and one of an inner or outer gerotor. Still yet other technical advantages of other embodiments may include the capability to create a journal bearing between a housing and one of an inner or outer gerotor. Still yet other technical advantages of other embodiments may include the capability to utilize a motor imbedded in one of an inner or outer gerotor.

Although specific advantages have been enumerated above, various embodiments may include all, some, or none of the enumerated advantages. Additionally, other technical advantages may become readily apparent to one of ordinary skill in the art after review of the following figures and description.

BRIEF DESCRIPTION OF THE DRAWINGS

For a more complete understanding of example embodiments of the present invention and its advantages, reference is now made to the following description, taken in conjunction with the accompanying drawings, in which:

FIG. 3 is a sealing system for an outer gerotor and a housing, according to an embodiment of the invention;

FIGS. 4A, 4B, and 4C illustrate an operation of the first seat, the second seat, and the tubing in the sealing system of FIG. 3, according to an embodiment of the invention;

DETAILED DESCRIPTION OF EXAMPLE EMBODIMENTS OF THE INVENTION

It should be understood at the outset that although example embodiments of the present invention are illustrated below, the present invention may be implemented using any number of techniques, whether currently known or in existence. The present invention should in no way be limited to the example embodiments, drawings, and techniques illustrated below, including the embodiments and implementation illustrated and described herein. Additionally, the drawings are not necessarily drawn to scale.

FIGS. 1 through 22 below illustrate example embodiments of engine systems within the teachings of the present invention. Although the detailed description will describe these engine systems as being used in the context of a gerotor compressor, some of the engine system may function equally as well as gerotor expanders and/or combinations of gerotor expanders and compressors. In addition, the present invention contemplates that the engine systems described below may be utilized in any suitable application; however, the engine systems described below are particularly suitable for a quasi-isothermal Brayton cycle engine, such as the one described in U.S. Pat. No. 6,336,317 B1 ("the '317 patent") issued Jan. 8, 2002. The '317 patent, which is herein incorporated by reference, describes the general operation of a gerotor compressor and/or a gerotor expander. Hence, the operation of some of the engine systems described below may not be described in detail. In addition, in some embodiments, the technology described herein may be utilized in conjunction with the technology described in U.S. patent application Ser. Nos. 10/359,487 and 10/359,488, both of which are herein incorporated by reference.

Figure 1:
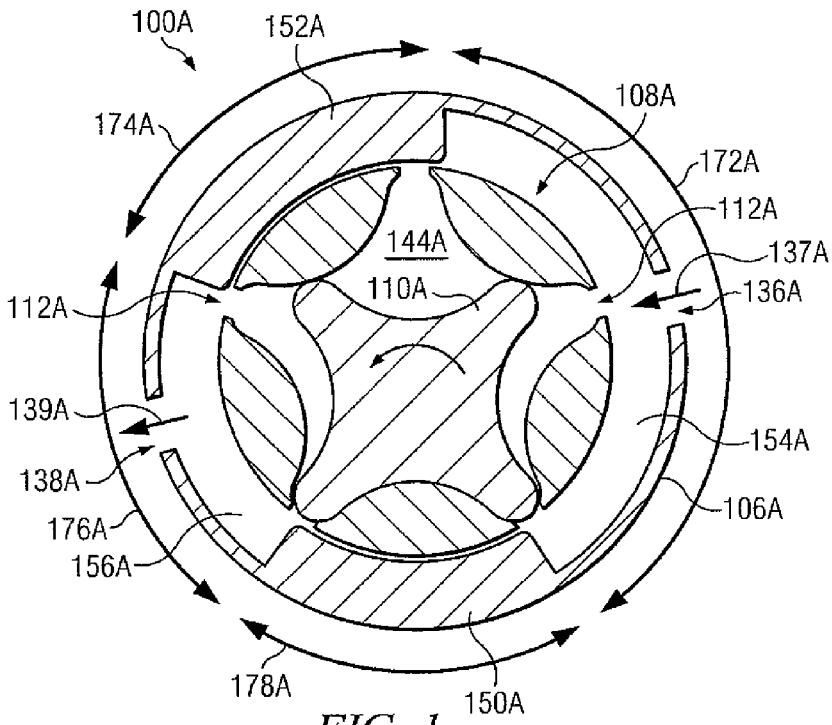
FIG. 1 is a side cross-sectional view of an engine system, according to an embodiment of the invention.

FIG. 1 is a side cross-sectional view of an engine system 100A, according to an embodiment of the invention. The geometry of the engine system 100A of FIG. 1 may be used as either an expander or a compressor. However, for purposes of illustration, the engine system 100A of FIG. 1 will be described as a compressor.

The engine system 100A in the embodiment of FIG. 1 includes a housing 106A, an outer gerotor 108A, and an inner gerotor 110A. The housing 106A includes a tip inlet port 136A and a tip outlet port 138A. The tip inlet port 136A allows fluids (e.g., gasses, liquids, or liquid-gas mixtures) to enter into the engine system 100A in the direction of arrow 137A. The tip outlet port 138A allows allow the fluids to exit the engine system 100A in the direction of arrow 139A.

The housing 106A additionally includes a first barrier 150A and a second barrier 152A operable to prevent a flow of fluids around the outer perimeter of the engine system 100A. The first and second barriers 150A and 152B at least partially define a perimeter fluid inlet area 154A and a perimeter fluid outlet area 156A. The shape, configuration and size of the first and second barriers 150A and 152A may be selected to achieve a desired shape, configuration and size of the perimeter fluid inlet area 154A and the perimeter fluid outlet area 156A to achieve a desired compression ratio or range of compression ratios of fluids passing through the engine system 100A.

The outer gerotor 108A includes one or more openings 112A which allow fluids to enter into and exit from an outer gerotor chamber 144A. The inner gerotor 110A in this embodiment is rotating in a counter-clockwise direction. In other embodiments, the inner gerotor 110A may rotate in a clock-wise direction. The engine system 100A of this embodiment may be viewed as having an intake section 172A, a compression section 174A, an exhaust section 176A, and a sealing section 178A.

Although a general shape and configuration of the inner gerotor 110A and the outer gerotor 108A have been shown in the embodiment of FIG. 1, a variety of other shape and configurations for the inner gerotor 110A and the outer gerotor 108A may be used in other embodiments.

If the engine system 100A were utilized as an expander, the tip inlet port 136A may become a tip outlet port and the tip outlet port 138A may become a tip inlet port.

Figure 2:
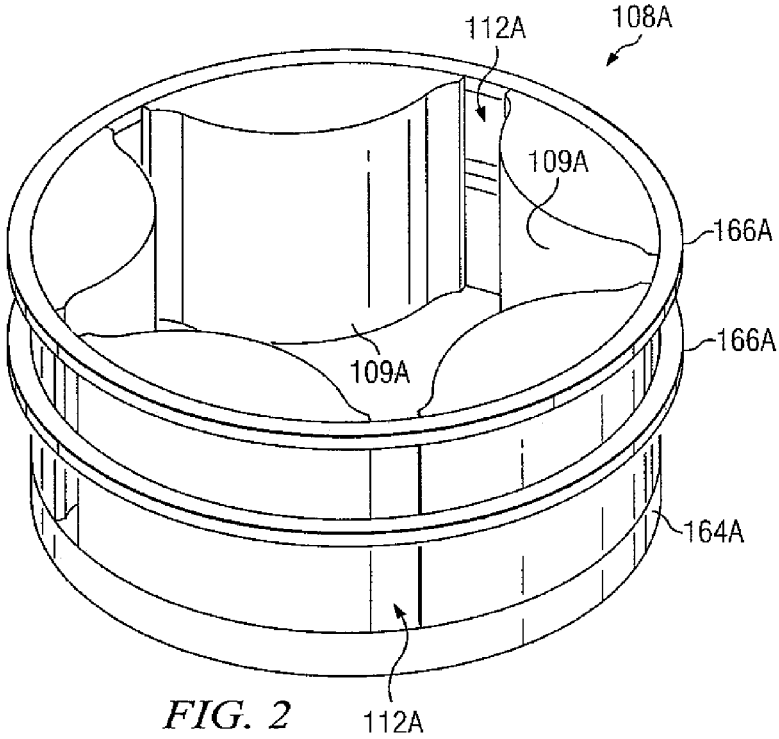
FIG. 2 is a perspective view of the outer gerotor of FIG. 1.

FIG. 2 is a perspective view of the outer gerotor 108A of FIG. 1. The outer gerotor 108A includes the plurality of openings 112A, described above in FIG. 1, as well as a base seat 164A and a plurality of support rings or strengthening bands 166A. The outer gerotor 108A includes a plurality of outer gerotor portions 109A, which extend in a cantilevered manner from the base seat 164A. The support rings or strengthening bands 166A wrap around the plurality of outer gerotor portions to provide support to the outer gerotor portions 109A of outer gerotor 108A. As an illustrative example, as the outer gerotor 108A begins to spin, centrifugal forces may tend to splay the outer gerotor portions 109A outwardly from the cantilevered support of the base seat 164A. Accordingly, the support rings or strengthening bands 166A provide structural support to the outer gerotor portions 109A to prevent such splaying.

The support rings or strengthening bands 166A may be made of a plurality of materials, either similar or different than the material utilized in the outer gerotor 108A. Examples of materials that may be utilized in the support rings or strengthening bands 166A include graphite fibers, other high-strength, high-stiffness materials, or other suitable materials.

FIG. 3 is a sealing system 104A for an outer gerotor 108A and a housing 106A, according to an embodiment of the invention. FIG. 3 shows a side cut-away view of an outer gerotor 108A with a plurality of support rings or strengthening bands 166A supporting outer gerotor portions 109A.

The portion of the housing 106A that sealingly interacts with the outer gerotor 108A is the barriers 150A or 152A. For purposes of brevity, only barrier 152A is shown. Barrier 152A includes a plurality of grooves 153A. Each of the plurality of grooves 153A includes a first seat 154A and a second seat 155A. The second seat 155A includes tubing 156A disposed therein. Details of an operation of the first seat 154A, the second seat 155A, and the tubing 156A are described below with reference to FIGS. 4A, 4B, and 4C. The support rings or strengthening bands 166A are operable to be disposed in and rotate within the grooves 153A. In particular embodiments, the strengthening bands 166A may abrade away the first seat 154A and the second seat 156A. In other embodiments, the strengthening bands 166A may not abrade away the first seat 154A and the second seat 156A.

FIGS. 4A, 4B, and 4C illustrate an operation of the first seat 154A, the second seat 155A, and the tubing 156A in the sealing system 104A, according to an embodiment of the invention. During operation, the temperature of the outer gerotor 108A (including associated outer gerotor portions 109) may increase for a variety of reasons (e.g., due to heat from compression), thereby causing the outer gerotor 108A to expand leftward from a thermal datum 190A. Accordingly, the sealing system 104A in particular embodiments may be designed as an adjustable seal, which compensates for expansion of the outer gerotor 108A.

Each the first seats 154A and the second seats 155A may be made of abradable material, which allows for tight clearances as the parts wear. The first seat 154A in particular embodiments may simply include a solid strip of abradable material. The second seat 155A in particular embodiments may include abradable material with tubing 156A disposed therein. The tubing 156A may be designed to expand when pressure is applied. A variety of different configurations my be utilized in allowing the center tubing 156 to expand, including, but not limited to an application of fluid, such as hydraulic fluid or other suitable fluid. Upon expanding, the second seat 155A reduces the gap in the groove 153A. Although tubing 156A has only been shown in the second seat 155A, in other embodiments the tubing may be on the first seat 154A as well. In other embodiments, either one or both of the first seat 154A and the second seat 156A may be mechanically actuated to reduce the gap in the groove 153A and allow a seating of the support rings or strengthening bands 166A.

FIG. 4A shows the outer gerotor 108A in a cold state—before expansion. The gap in the grooves 156A are open. FIG. 4B shows the outer gerotor 108A in a heated state—expanding leftward from the thermal datum 190A. As the outer gerotor 108A expands leftward, the support rings or strengthening bands 166A may be pushed against the first seat 154A. The gap in the grooves 156A are still open. FIG. 4C shows an application of pressure to the tubing 156A, thereby reducing the gap in the groove 153A and forcing the second seat 155A up against the support rings or strengthening bands 166A to create a seal. During this operation, the barrier 152A may additionally expand, but only in a relatively small manner compared to the outer gerotor 108A. As briefly referenced above, after the seal is created, the rotation of the support rings or strengthening bands 166A through the grooves 153A may cause the first seat 154A and second seat 155A to abrade away. Accordingly, in particular embodiments, the first seat 154A and second seat 155A may be replaced as needed.

Figure 5:
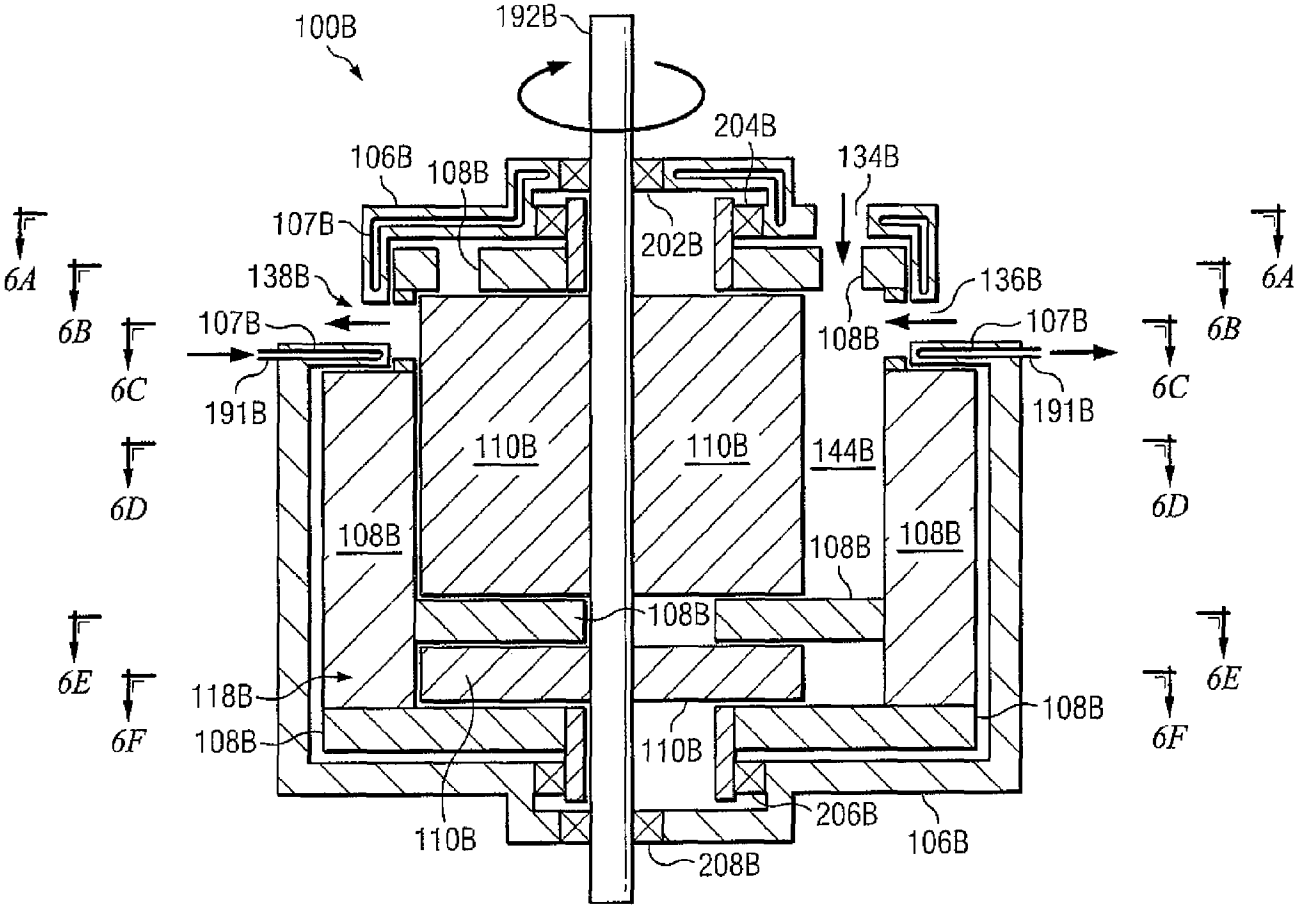
FIG. 5 is a side cross-section view of an engine system, according to another embodiment of the invention.

FIG. 5 is a side cross-section view of an engine system 100B, according to another embodiment of the invention. Although one specific configuration of an engine system 100B is described in FIG. 5, it should be expressly understood that engine system 100B may utilize more, fewer, or different components parts, including but not limited the components from various configurations described herein with reference to other embodiments. The engine system 100B of FIG. 5 may be designed as a compressor, expander, or both, depending on the embodiment or intended application. For purposes of illustration, the engine system 100B will be described as a compressor.

The engine system 100B in the embodiment of FIG. 5 includes a housing 106B, an outer gerotor 108B, an inner gerotor 110B, a shaft 192B, and a synchronizing mechanism 118B. The outer gerotor 108B is at least partially disposed within the housing 106B and the inner gerotor 110B is at least partially disposed within the outer gerotor 108B. More particularly, the outer gerotor 108B at least partially defines an outer gerotor chamber 144B and the inner gerotor 110B is at least partially disposed within the outer gerotor chamber 144B.

Figure 6A:
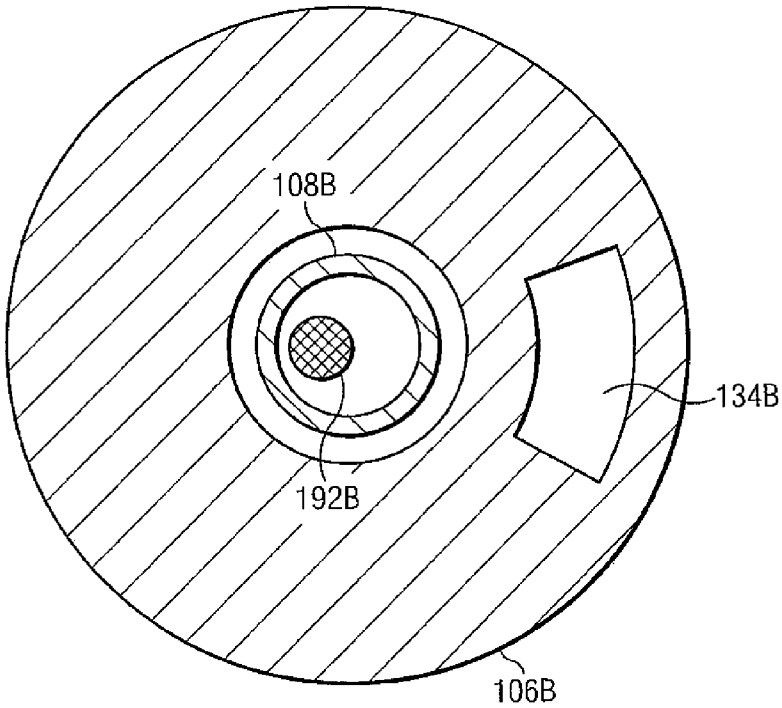
FIG. 6A is a cross section taken along line 6A-6A of FIG. 5.
Figure 6B:
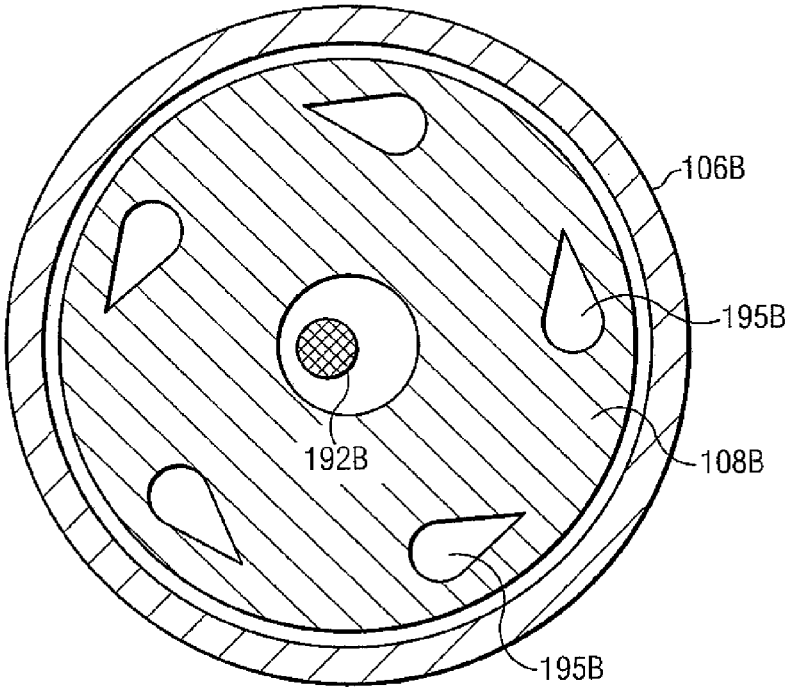
FIG. 6B is a cross section taken along line 6B-6B of FIG. 5.

The housing may include a tip inlet port 136B, a face inlet port 132B, and a tip outlet port 138B. The tip inlet port 136B and the face inlet port 132B generally allow fluids, such as gasses, liquids, or liquid-gas mixtures, to enter the outer gerotor chamber 144A. Likewise, the tip outlet port 138B generally allow the fluids within outer gerotor chamber 144A to exit from outer gerotor chamber 144A. The combination of the two inlet ports, a tip inlet port 136B and a face inlet port 132B, may allow entry of additional fluids in the outer gerotor chamber 144A. FIGS. 6A and 6B show further details of supplementing the tip inlet port 136B with the face inlet port 132B.

The tip inlet port 136B, the face inlet port 132B, and the tip outlet port 138B may have any suitable shape and size. Depending on the particular use or the engine system 100B, in some embodiments, the total area of the tip inlet port 136B and the face inlet port 132B may be different than the total area of the tip outlet port 138B.

As shown in FIG. 5, inner gerotor 110B may be rigidly coupled to the shaft 192B, which is rotatably coupled to a hollow cylindrical portion of housing 106B by one or more bearings 202B, 208B, such as ring-shaped bearings. Accordingly, the shaft 192B and the inner gerotor may rotate about a first axis. In some embodiments, the shaft 192B may be a drive shaft operable to drive the inner gerotor 110B.

The outer gerotor 110B is rotatably coupled to the interior of the housing 106B by one or more bearings 204B, 206B such as ring-shaped bearings. The outer gerotor 110B may rotate about a second axis different than the first axis.

The synchronizing system 118B may take on a variety of different configurations. Further details of one configuration for the synchronizing system 118B are described below with reference to FIG. 6F.

In operation, when the engine system 100B of FIG. 5 starts spinning and becomes hot, components of the engine system 100B may begin to change and/or expand, causing, among other things, disturbance of the seals (e.g., between the housing 106B and the outer gerotor 108B) in the engine system 100B. Accordingly, the engine system 100B of FIG. 5 may incorporate channels 107B into the housing 106B to regulate temperature. The regulation of temperature, among other things, helps to prevent warping due to uneven temperature distributions in the engine system 100B.

In particular embodiments, the channels 107B may be located at points where expansion would be expected to occur for both centrifugal and thermal reasons. The channels 107B may receive any suitable type of fluid for temperature regulations. Such channels may have one or more fluid inlets 191B and one or more fluid outlets 192B. And, in some embodiments, electrical heating strips may be used at the location of the channels 107B.

In particular embodiments, the channels 107B or electrical heating strips may allows the housing 106B to be heated prior to starting the engine system 100B. The resulting thermal expansion lifts the housing 106B away from the ports (e.g., tip inlet port 136B and the tip outlet port 138B), thereby preventing abrasion of sealing surfaces during start-up. Once the engine system 100B is operating at steady state and the component parts are fully expanded due to heating, the temperature of the housing 106B can be reduced, for example, through the channels 107B, thereby closing gaps and allowing abradable seals to function. For example, the components (e.g., the outer gerotor 108B) may be allowed to seat on an abradable seat.

Abradable seals utilized in the engine system 100B (e.g., between the housing 106B and the outer gerotor 108B) may be constructed from a variety of materials such as Teflon polymers or molybdenum disulfide. Additionally, the surfaces may be made of a roughened metal. In such embodiments, the roughened metal may act like sand paper and abrades away the abradable material coating the other surface. To prevent galling between components parts, dissimilar metals may be used, such as aluminum and steel. In embodiments using a high-temperature expander, one surface may be a highly porous silicon carbide and the other a dense silicon carbide. Porous silicon carbide may be made from polymers containing silicon, carbon, and hydrogen, such as those sold by Starfire Systems, Inc.

FIG. 6A is a cross section taken along lines 6A-6A of FIG. 5. FIG. 6A shows the housing 106B, the shaft 192B, the outer gerotor 108B, and the face inlet port 134B though the housing 106B.

FIG. 6B is a cross section taken along lines 6B-6B of FIG. 5. FIG. 6B shows the housing 106B, the shaft 192B, the outer gerotor 108B and a plurality of gerotor chamber face inlet ports 195B disposed in the outer gerotor 108B. The gerotor chamber face inlet ports 195B in this embodiment are shown with a tear drop shape. In other embodiments, the gerotor chamber face inlet ports 195B may have other shapes. The shape and arrangement of the gerotor chamber face inlet ports 195B may be selected so that the gerotor chamber face inlet ports 195E are open during an intake portion of a cycle of the engine system 100B and blocked during an exhaust portion of the cycle of the engine system 100B. Such a configuration reduces dead volume because the inlet ports 195B are only selectively open, allowing passage of fluids, when the inlet ports 195B are adjacent the face inlet port 134B. The shape, structure, and location of the gerotor chamber face inlet ports 195B can be changed based upon the inner gerotor 110B and outer gerotor 108B utilized.

Figure 6C:
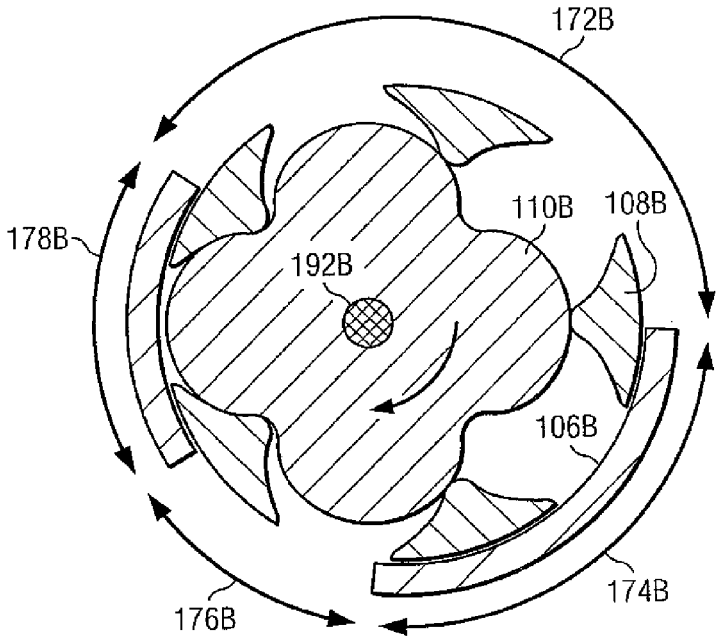
FIG. 6C is a cross section taken along line 6C-6C of FIG. 5.

FIG. 6C is a cross section taken along lines 6C-6C of FIG. 5. FIG. 6C shows the housing 106B, the shaft 192B, the inner gerotor 110B, and the outer gerotor 108B. FIG. 6C also shows portions of the engine system 100B that may roughly correspond to an intake section 172B, a compression section 174B, an exhaust section 176B, and a sealing section 178B.

Figure 6D:
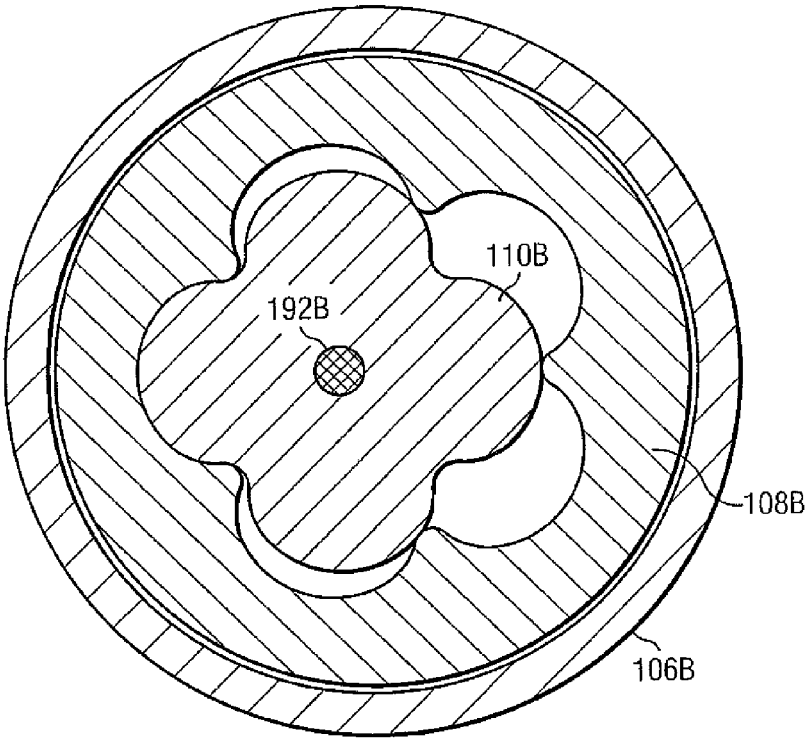
FIG. 6D is a cross section taken along line 6D-6D of FIG. 5.

FIG. 6D is a cross section taken along lines 6D-6D of FIG. 5. FIG. 6C shows the housing 106B, the shaft 192B, the inner gerotor 110B, and the outer gerotor 108B. In FIG. 6D, the outer gerotor 108B is not interrupted by any ports. Accordingly, the outer gerotor 108B can resist centrifugal forces without support rings or strengthening bands, for example, as described with reference to FIG. 2.

Figure 6E:
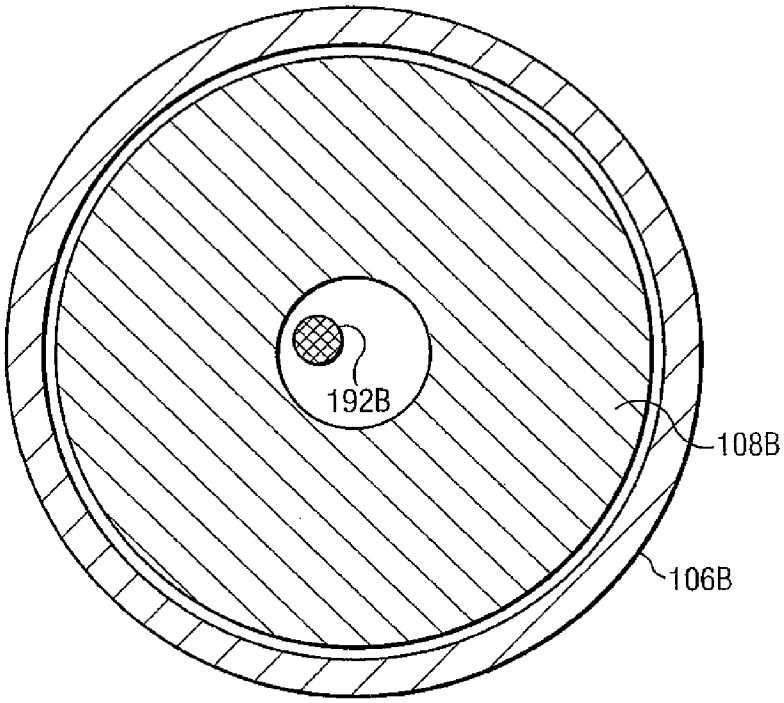
FIGS. 6E and 6F are cross sections respectively taken along line 6E-6E and line 6F-6F of FIG. 5.
Figure 6F:
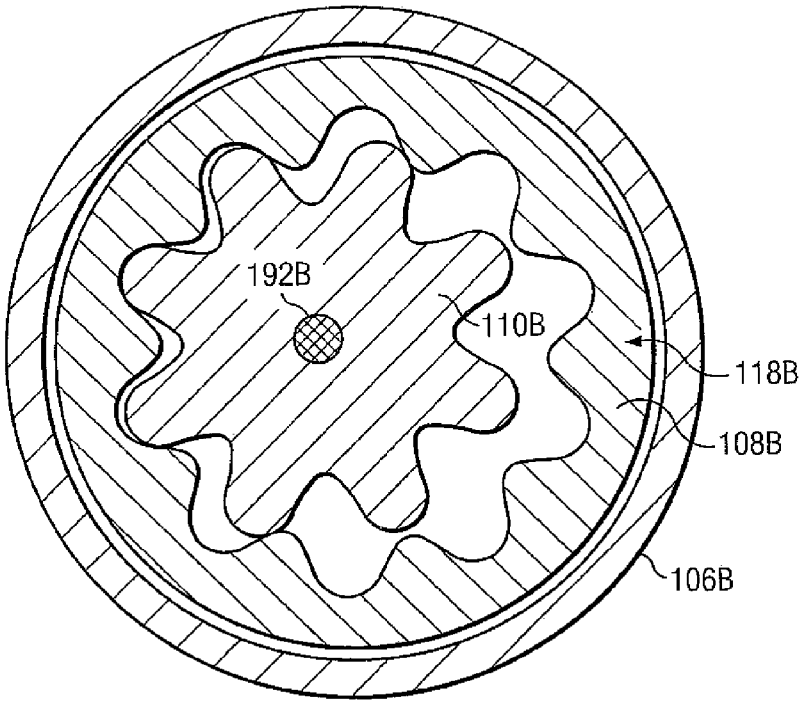

FIGS. 6E and 6F are cross sections respectively taken along lines 6E-6E and lines 6F-6F of FIG. 5. FIGS. 6E and 6F show the housing 106B, the shaft 192B, and the outer gerotor 108B. FIG. 6F also shows the inner gerotor 110B and further details of the synchronizing mechanism 118B. The synchronizing mechanism of FIG. 6F is a trochoidal gear arrangement between the inner gerotor 110B and the outer gerotor 108B. The synchronizing mechanism in other embodiments may include involute gears, peg-and-track systems, or other suitable synchronizing systems.

Figure 7A:
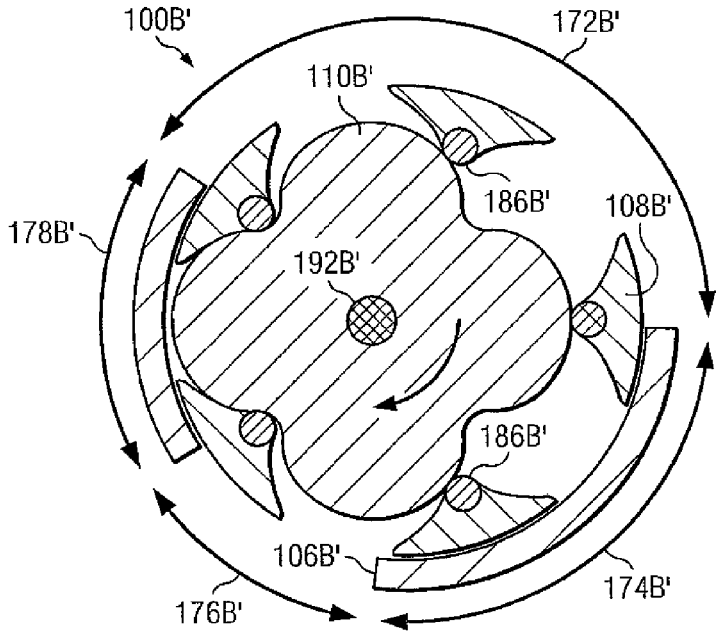
FIGS. 7A and 7B are top cross-sectional views of an engine system, according to another embodiment of the invention.
Figure 7B:
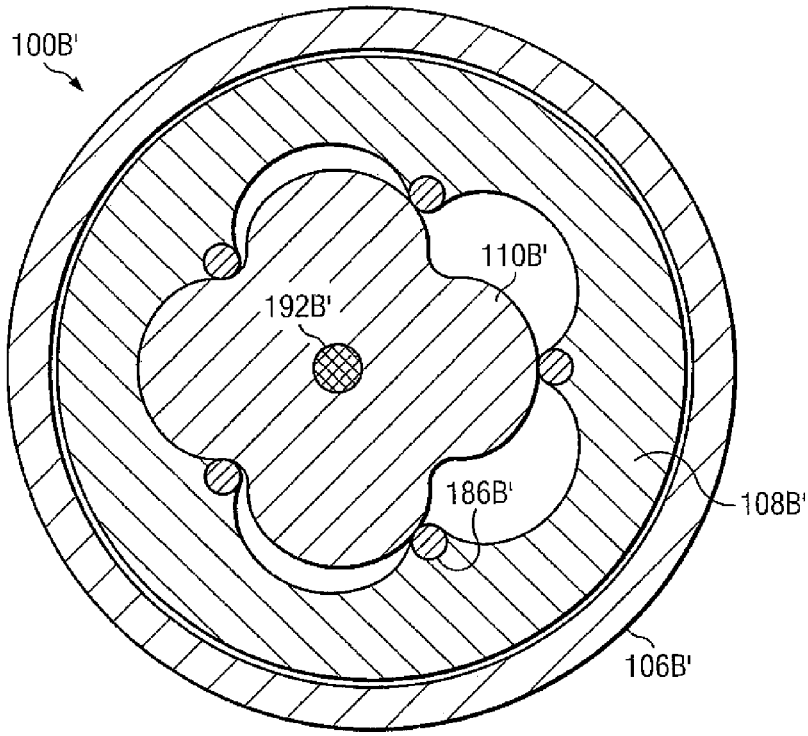

FIGS. 7A and 7B are top cross-sectional views of an engine system 100B', according to another embodiment of the invention. The cross sections of the engine system 100B' of FIGS. 7A and 7B are similar to cross sections of the engine system 100B of FIGS. 6C and 6D, showing shows a housing 106B', a shaft 192B', an inner gerotor 110B', and an outer gerotor 108B'. However, the outer gerotor 108B' of engine system 100B' also has an abradable tip 186B' disposed thereon. The abradable tip 186B' may be made of a softer material than the inner gerotor 110B'. Accordingly, as the inner gerotor 110B' rotates relative to the outer gerotor 108B', the inner gerotor 110B' abrades away the abradable tips 186B', thereby preserving the inner gerotor 110B'. The abradable tips 186B' may be replaced during maintenance of the engine system 200B'.

Figure 8:
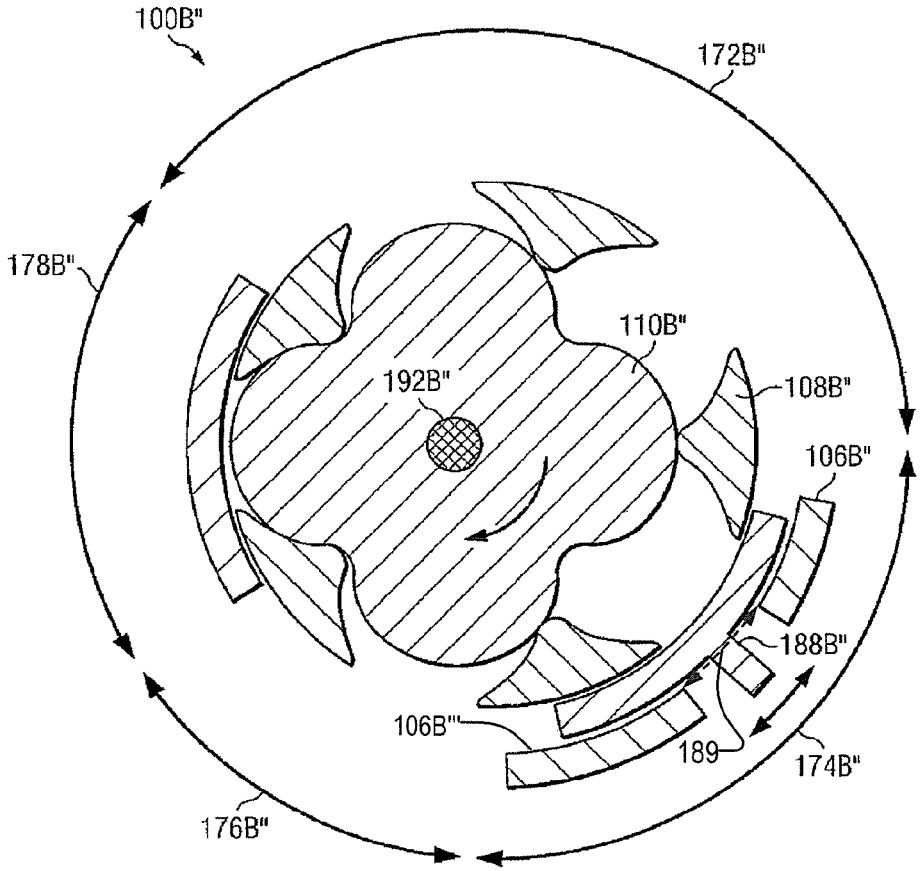
FIG. 8 is a top cross-sectional view of an engine system, according to another embodiment of the invention.

FIG. 8 is a top cross-sectional view of an engine system 100B", according to another embodiment of the invention. The cross section of the engine system 100B" of FIG. 8 is similar to cross section of the engine system 100B of FIG. 6C, showing a housing 106B", a shaft 192B", an inner gerotor 110B', an outer gerotor 108B" and portions of the engine system 100B" that may roughly correspond to an intake section 172B', a compression section 174B", an exhaust section 176B', and a sealing section 178B'. However, the housing 106B' of the engine system 100B' also includes a slider 188B". The slider 188B" is a portion of the housing 106B" that defines the compression ratio. The slider 188B" may change the compression ratio by circumferentially sliding in either direction with respect to a circumferential wall 106B' of the housing 106B'. As seen, the slider 188B" has a maximum length 189 of circumferential movement and maintains a radial distance between the slider 188B'" and the circumferential wall 106B'" over the maximum length 189 because both the slider 188B" and the circumferential wall 106B'" have the same circumferential configuration. Additionally, one of ordinary skill in the art reviewing this specification will recognize that each location along the maximum length 189 provides a different compression ratio. Any of a variety of different configurations may be utilized to enable the sliding of the slider 188B" relative to the remainder of the housing 106B".

Figure 9:
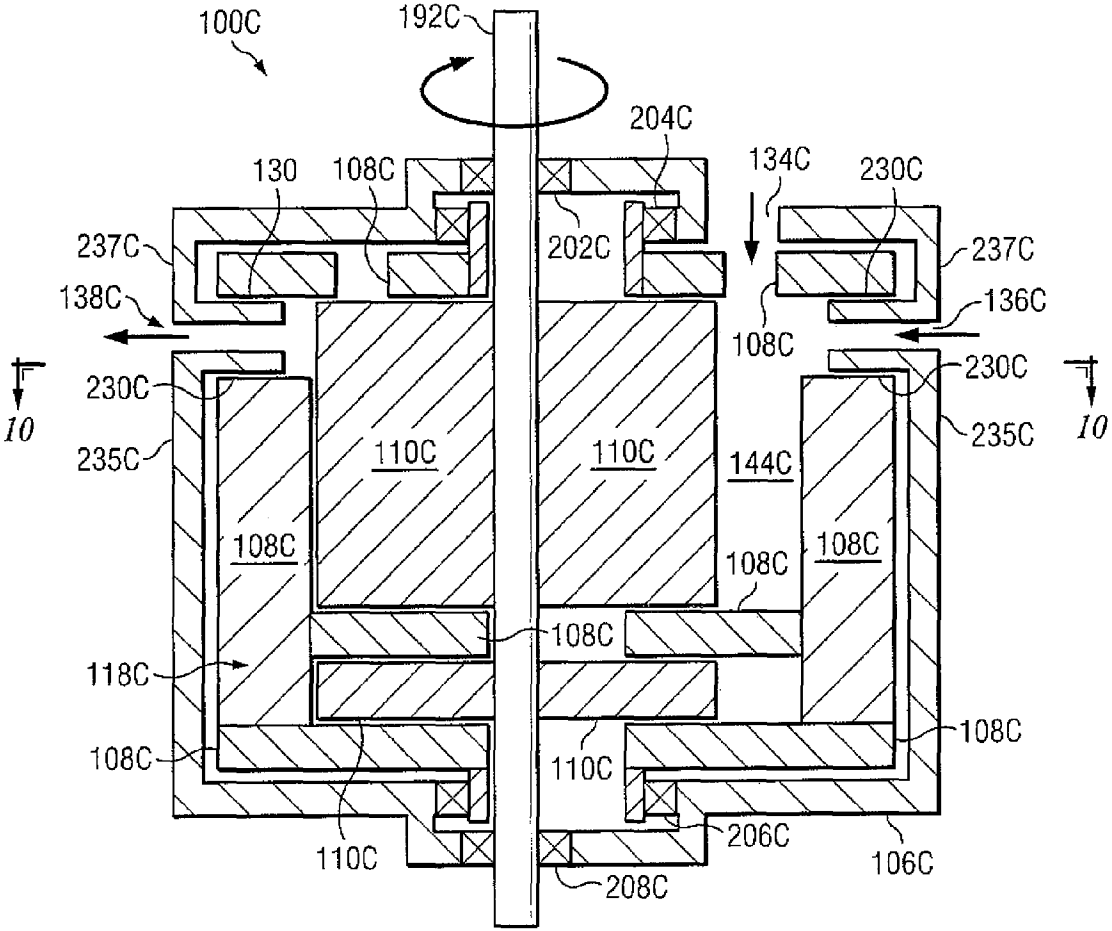
FIG. 9 is a side cross-sectional view of an engine system, according to another embodiment of the invention.

FIG. 9 is a side cross-sectional view of an engine system 100C, according to another embodiment of the invention. The engine system 100C of FIG. 9 may include features similar to the engine system 100B of FIG. 5, including a housing 106C, an outer gerotor 108C, an inner gerotor 110C, an outer gerotor chamber 144C, a shaft 192C, a synchronizing mechanism 118C, a tip inlet port 136C, a face inlet port 132C, a tip outlet port 138C and bearings 202C, 204C, 206C, and 208C. Similar to engine system 100B, the engine system 100C in various embodiments may include more, fewer, or different component parts, including but not limited the components from various configurations described herein with reference to other embodiments. Further, the engine system 100C of FIG. 9 may be designed as a compressor, expander, or both, depending on the embodiment or intended application. For purposes of illustration, the engine system 100C will be described as a compressor. The embodiment of the engine system 100C of FIG. 9 differs from the embodiment of the engine system 100B, described herein, in the configuration of the tip inlet port 136C and the tip outlet port 138C.

In operation, there may be some fluid (e.g., gas or liquid-gas mixtures) leakage in a gap 230C between the housing 106C and the outer gerotor 108C at both the tip inlet port 136C and the tip outlet port 138C. As fluid leaks between the gaps 230C, a pressure distribution may develop and act on the outer gerotor 108C, forcing the outer gerotor 108C to move away from the gap 230C. Such movement, among other things, may create undesirable axial loading on the bearings (e.g., bearing 204C and 206C). Accordingly, the engine system 100C of FIG. 9 may utilize symmetry in a top portion 237C and a bottom portion 235C of the tip inlet port 136C and the tip outlet port 138C to allow creation of similar forces in each gap 230C that balance one another and thereby reduce potential negative effects, including the undesirable axial loading on the bearings. In other words, the similar forces created by the gaps 230C work against one another to create a net force of substantially zero at the tip inlet port 136C and the tip outlet port 138C. In the embodiment of FIG. 9, the symmetry is created by wrapping bottom portion 235C of housing 106C and top portion 237C of housing 106C radially inward at the tip inlet port 136C and the tip outlet port 138C.

Figure 10:
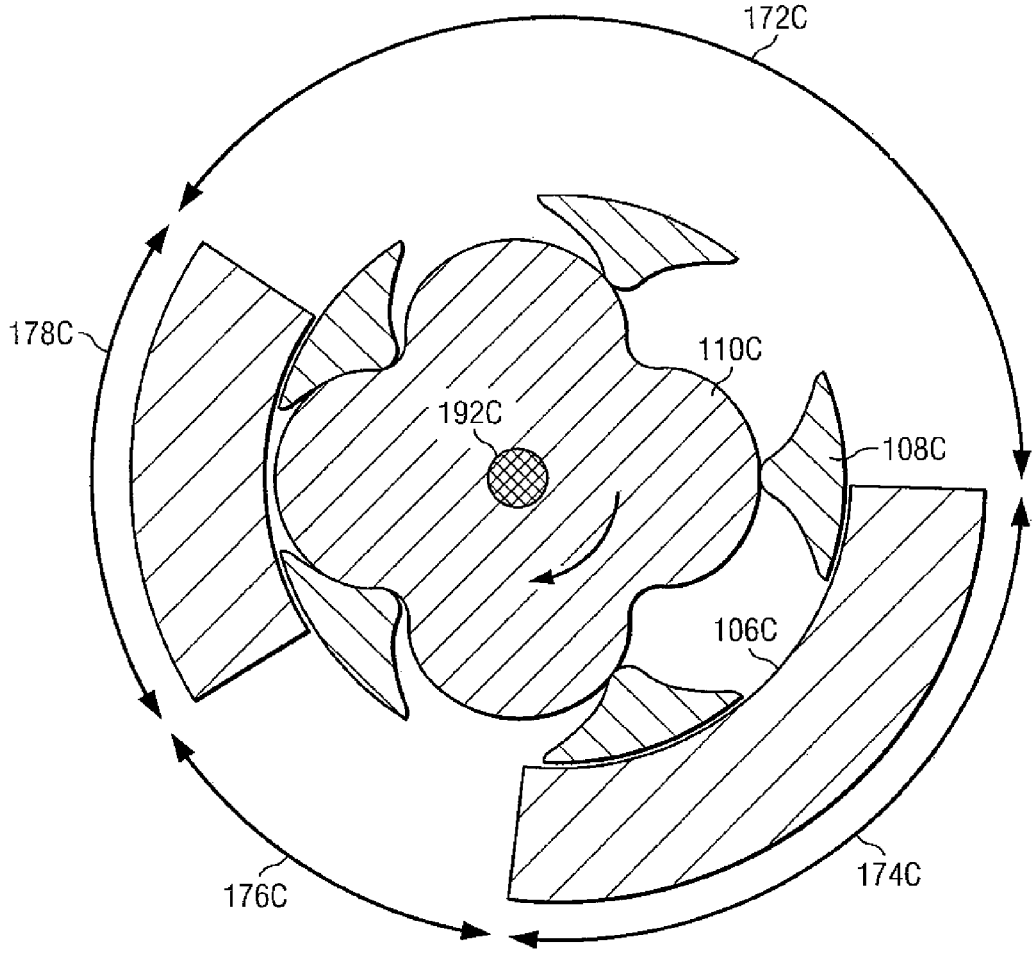
FIG. 10 is a cross-section, cut across either one of the line 10-10 of FIG. 9.

FIG. 10 is a cross-section, cut across either one of the lines 10-10 of FIG. 9. Because the top portion 237C and the bottom portion 235C of the tip inlet port 136C and the tip outlet port 138C are substantially similar, the cross-sections across either of lines 10-10 of FIG. 9 will also be substantially similar. FIG. 10 shows the housing 106C, the outer gerotor 108C, the inner gerotor 110C, and the shaft 192C. FIG. 10 also shows how respective portions of the engine system 100C may be viewed as an intake section 172C, a compression section 174C, an exhaust section 176C, and a sealing section 178C.

Figure 11:
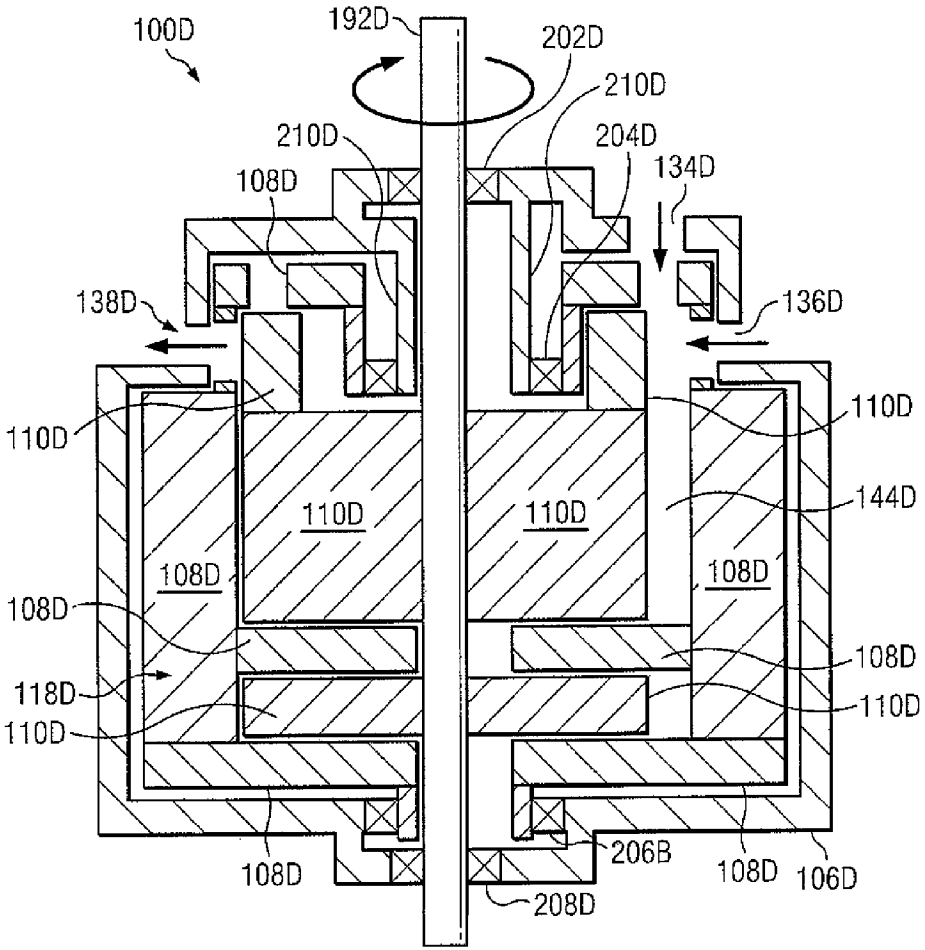
FIG. 11 is a side cross-sectional view of an engine system, according to another embodiment of the invention.

FIG. 11 is a side cross-sectional view of an engine system 100D, according to another embodiment of the invention. The engine system 100D of FIG. 11 may include features similar to the engine system 100B of FIG. 5, including a housing 106D, an outer gerotor 108D, an outer gerotor chamber 144D, an inner gerotor 110D, a shaft 192D, a synchronizing mechanism 118D, a tip inlet port 136D, a face inlet port 132D, a tip outlet port 138D and bearings 202D, 204D, 206D, and 208D. And, similar to engine system 100B, engine system 100D in various embodiments may include more, fewer, or different component parts, including but not limited the components from various configurations described herein with reference to other embodiments. The engine system 100D of FIG. 11 may be designed as a compressor, expander, or both, depending on the embodiment or intended application. For purposes of illustration, the engine system 100D of FIG. 11 will be described as a compressor. The embodiment of the engine system 100D of FIG. 11 differs from the embodiment of the engine system 100B, described herein, in the arrangement of various components, for example, bearing 204D.

As briefly referenced with reference to FIGS. 4A, 4B, and 4C, above, components of a system may expand (e.g., for thermal reasons) from a thermal datum. In such expansion, it desirable to avoid perturbances of seals between the housing 106D and the outer gerotor 108D or seals between other components. Accordingly, the engine system 100D of FIG. 11 moves a thermal datum 190D of the engine system 100D into substantially the same plane as a seal between the housing 106D and the outer gerotor 108D. In other embodiments, the thermal datum 190D may be substantially in the same plane as seals between other components (e.g., seal between the housing 106D and the inner gerotor 110D). With such configurations, thermal expansion occurs away from the thermal datum 190D and seals, thereby minimizing perturbances of seals between the housing 106D and the outer gerotor 108D or seals between other components. In such configurations, the thermal datum may also be viewed as substantially within the same plane of the tip inlet port 136D and the tip outlet port 138D.

In particular embodiments, the thermal datum 190D may be moved substantially into the same plane as a seal between the housing 106D and the outer gerotor 108D by moving bearing 204D down into the engine system 100D in a configuration that resists axial movement. More particularly, the bearing 204D is positioned radially outward from a portion 210D of the housing 106D that extends down into the engine system 100D. Other arrangements, including other bearing configurations may additionally be utilized, to move the thermal datum into substantially the same plane as a seal between the housing 106D and the outer gerotor 108D or a seal between other components.

Figure 12:
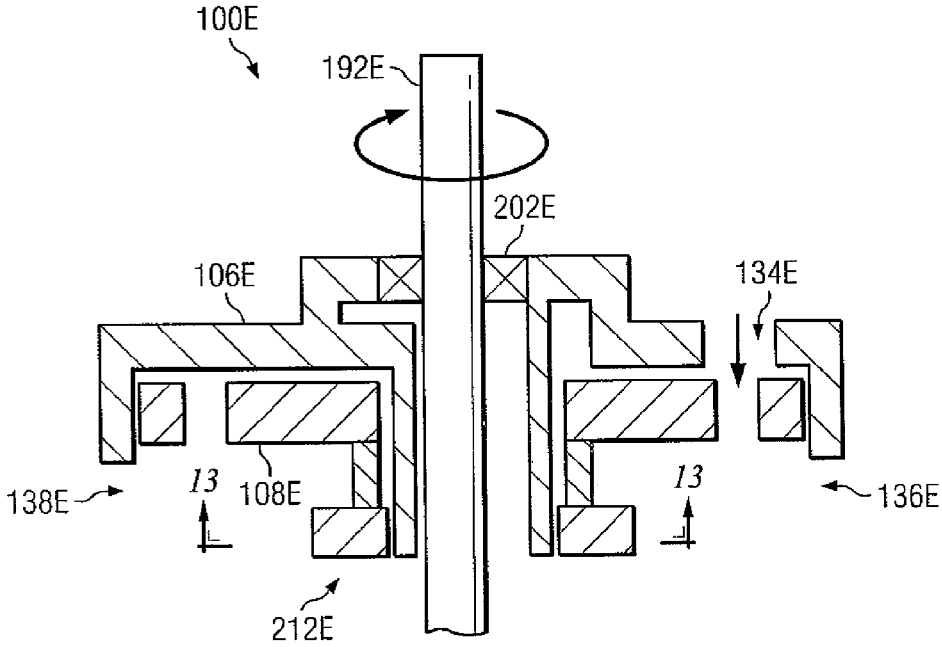
FIG. 12 is a side cross-sectional view of an upper portion of an engine system, according to another embodiment of the invention.

FIG. 12 is a side cross-sectional view of an upper portion of an engine system 100E, according to another embodiment of the invention. The upper portion of the engine system 100E of FIG. 11 may include features similar to the engine system 100D of FIG. 11, including a housing 106E, an outer gerotor 108E, an inner gerotor 110E, a shaft 192E, a tip inlet port 136E, a face inlet port 132E, a tip outlet port 138E, and a bearing 202E. And, similar to engine system 100D, engine system 100E in various embodiments may include more, fewer, or different component parts, including but not limited the components from various configurations described herein with reference to other embodiments. The engine system 100E of FIG. 12 may be designed as a compressor, expander, or both, depending on the embodiment or intended application. The embodiment of the engine system 100E of FIG. 12 differs from the embodiment of the engine system 100D, described herein, in that engine system 100E employs a journal bearing 212E.

Journal bearings are generally desirable because in particular configurations they are more economical than ball bearings and can take higher loads than ball bearings. However, conventional journal bearings generally have too large of a gap to allow for precision alignment of the sealing surfaces, and thus are not suitable for gerotor devices. Accordingly, the arrangement of the journal bearing 212E in the engine system 100E of FIG. 12 may be utilized to allow tight gaps. Further details of the journal bearing 212E are described below with reference to FIG. 13.

Figure 13:
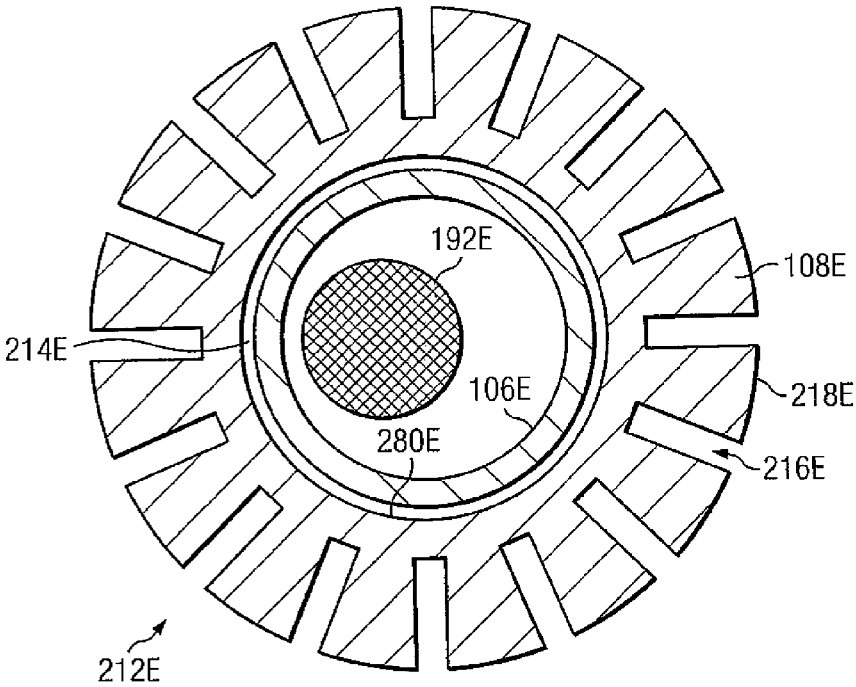
FIG. 13 is a cross-section of FIG. 12 taken across line 13-13 of FIG. 12.

FIG. 13 is a cross-section of FIG. 12 taken across lines 13-13 of FIG. 12. The journal bearing 212E is created by an interaction between the stationary housing 106E and the rotating outer gerotor 108E. In such an interaction, a variety of fluids (e.g., an oil film) suitable for the journal bearing 212E may be positioned in a gap 214E between the housing 106E and the outer gerotor 108E. And, the outer gerotor 108E may include a plurality of portions 218E circumferentially disposed around the outer gerotor 108E. A slot 216E may also be disposed between each portion 218E. At low rotational speeds of the outer gerotor 108E, the gap 214E may be small with little, if any, centering forces (pressures created by the fluid in the gap 214E). As the outer gerotor 108E begins to speed up, the weight of the portions 118E stretch an inner circumference 280E of the outer gerotor 108E, thereby opening up the gap 214E. Simultaneously, hydrodynamic centering forces are developed. At high speeds, the centering forces are significant and thus may provide the necessary centering precision for the outer gerotor 108E. The gap 214E in the journal bearing 212E can expand readily because the slots 216E (which may have a helical pattern when viewed from the exterior of the journal bearing 212E) in the outer periphery make the journal bearing 212E flexible.

Figure 14:
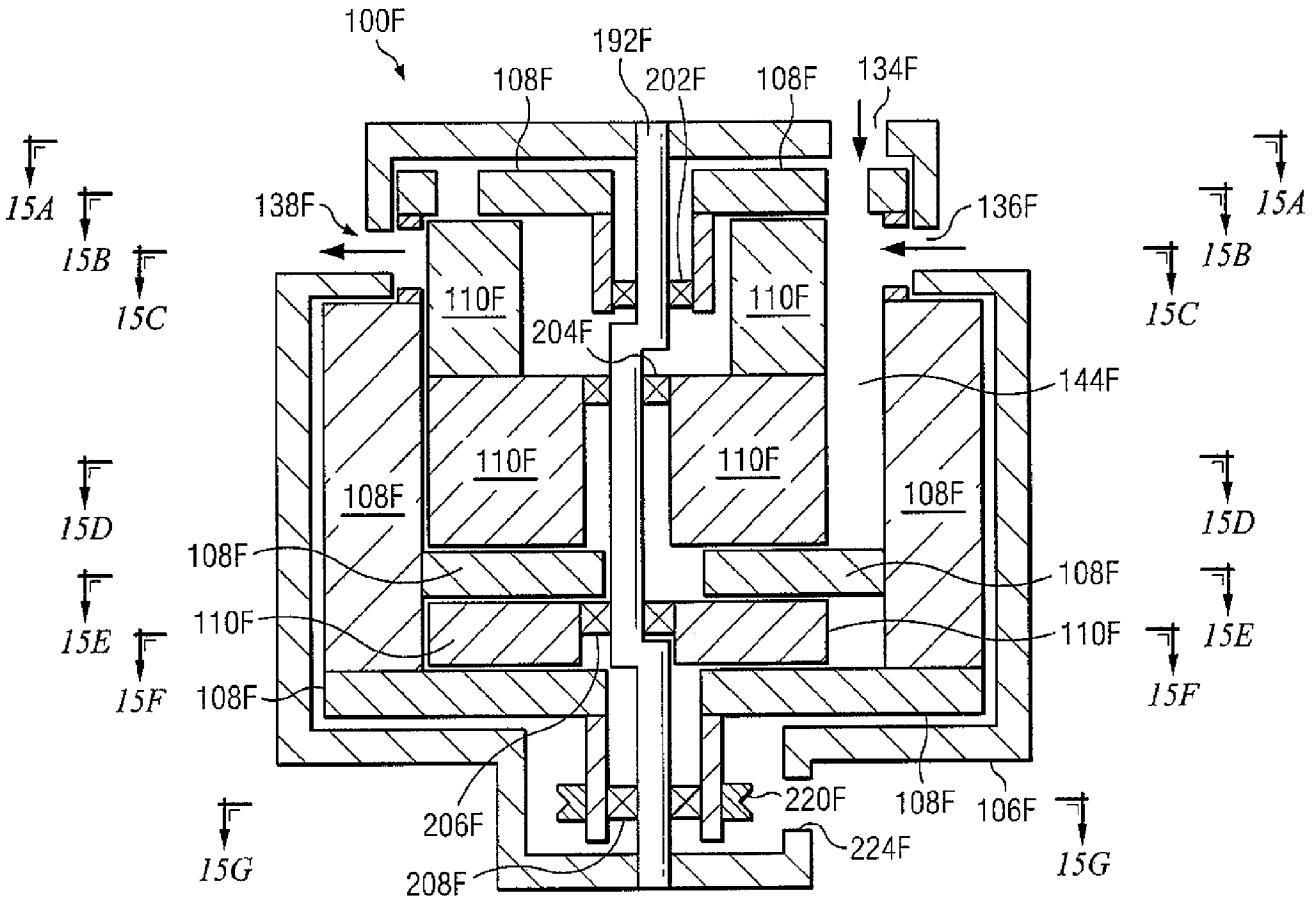
FIG. 14 is a side cross-sectional view of an engine system, according to another embodiment of the invention.

FIG. 14 is a side cross-sectional view of an engine system 100F, according to another embodiment of the invention. The engine system 100F of FIG. 14 may include features similar to the engine system 100B of FIG. 5, including a housing 106F, an outer gerotor 108F, an inner gerotor 110F, an outer gerotor chamber 144F, a shaft 192F, a synchronizing mechanism 118F, a tip inlet port 136F, an face inlet port 132F, a tip outlet port 138F and bearings 202F, 204F, 206F, and 208F. And, similar to engine system 100B, engine system 100F in various embodiments may include more, fewer, or different component parts, including but not limited the components from various configurations described herein with reference to other embodiments. The engine system 100F of FIG. 14 may be designed as a compressor, expander, or both, depending on the embodiment or intended application.

The embodiment of the engine system 100F of FIG. 14 differs from the embodiment of the engine system 100B, described herein, in that the shaft 192F of engine system 100F is stationary or rigid with respect to the housing 106F. Accordingly, engine system 100F is powered through a pulley system 220F that powers the outer gerotor 108F. Although a pulley system 220F is shown, the engine system 100F could also be powered by a chain drive, a gear drive, or other suitable powering systems in other embodiments. To accommodate the pulley system 220F or other suitable powering system, the engine system 100F of FIG. 14 includes a power port 224F.

Figure 15A:
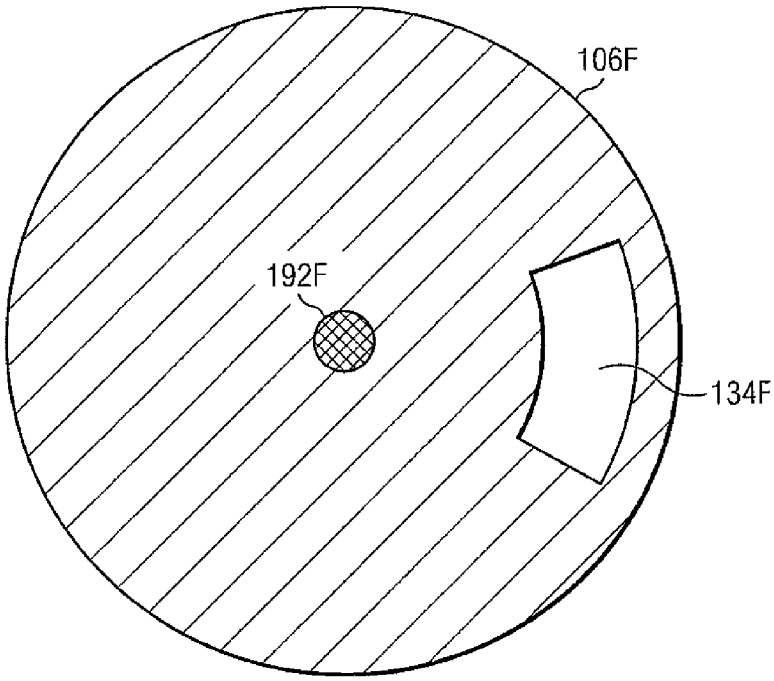
FIG. 15A is a cross section taken along line 15A-15A of FIG. 14.

FIG. 15A is a cross section taken along lines 15A-15A of FIG. 14. FIG. 15A shows the housing 106F, the shaft 192F, the outer gerotor 108F, and the face inlet port 134F though the housing 106F.

Figure 15B:
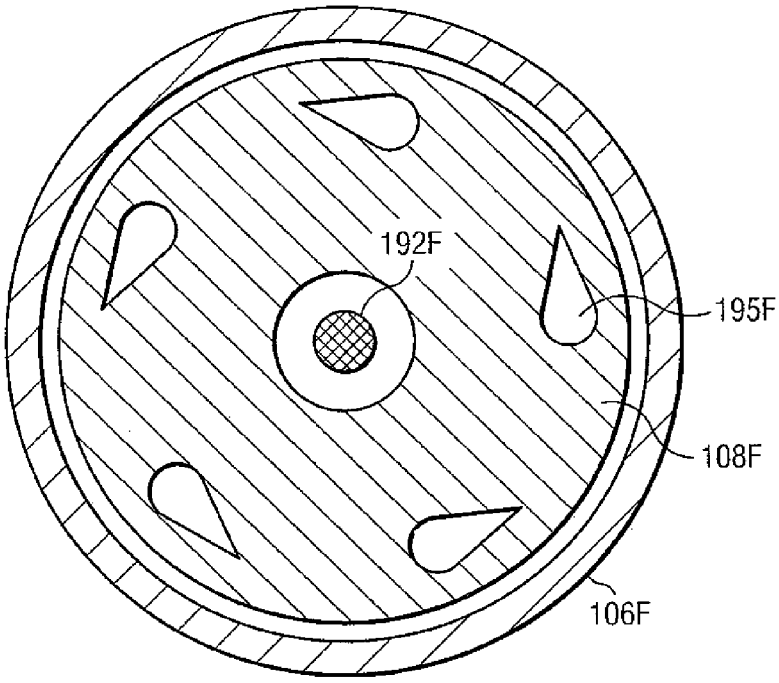
FIG. 15B is a cross section taken along line 15B-15B of FIG. 14.

FIG. 15B is a cross section taken along lines 15B-15B of FIG. 14. FIG. 15B shows the housing 106F, the shaft 192F, the outer gerotor 108F and a plurality of gerotor chamber face inlet ports 195F disposed in the outer gerotor 108F. The gerotor chamber face inlet ports 195B are shown with a tear drop shape. However, in other embodiments, the gerotor chamber face inlet ports 195F may have other shapes. In a manner similar to that described above with reference to FIG. 6B, the shape and arrangement of the gerotor chamber face inlet ports 195F of FIG. 15B may be selected so that the gerotor chamber face inlet ports 195F are open during an intake portion of the cycle and blocked during an exhaust portion of the cycle. Such a configuration reduces dead volume because the inlet ports 195F are only open, allowing passage of fluids, when the inlet ports are adjacent the face inlet port 134F. The shape, structure, and location of the gerotor chamber face inlet ports 195F can be changed based upon the inner gerotor 110F and the outer gerotor 108F utilized.

Figure 15C:
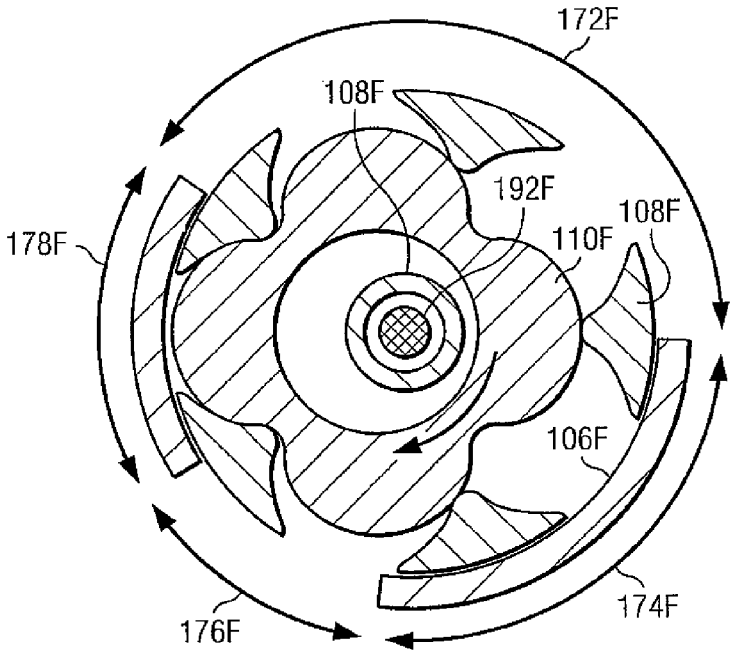
FIG. 15C is a cross section taken along line 15C-15C of FIG. 14.

FIG. 15C is a cross section taken along lines 15C-15C of FIG. 14. FIG. 15C shows the housing 106F, the shaft 192F, the inner gerotor 110F, and the outer gerotor 108F. FIG. 15C also shows portions of the engine system 100F that may roughly correspond to an intake section 172F, a compression section 174F, an exhaust section 176F, and a sealing section 178F.

Figure 15D:
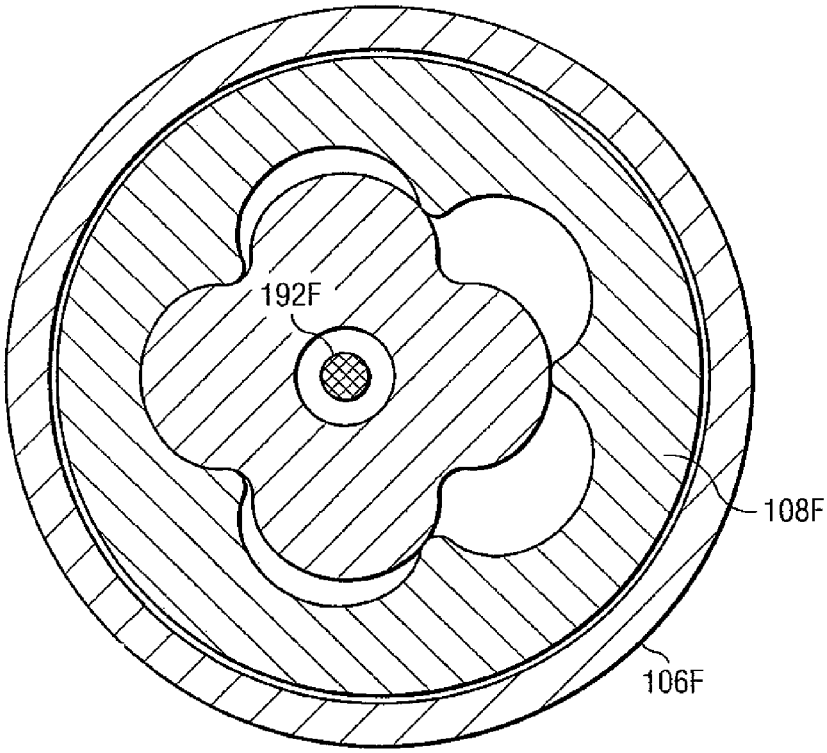
FIG. 15D is a cross section taken along line 15D-15D of FIG. 14.

FIG. 15D is a cross section taken along lines 15D-15D of FIG. 14. FIG. 15D shows the housing 106F, the shaft 192F, the inner gerotor 110F, and the outer gerotor 108F. In FIG. 15D, the outer gerotor 108F is not interrupted by ports. Accordingly, the outer gerotor 108F can resist centrifugal forces without support rings or strengthening bands, for example, as described with reference to FIG. 2.

Figure 15E:
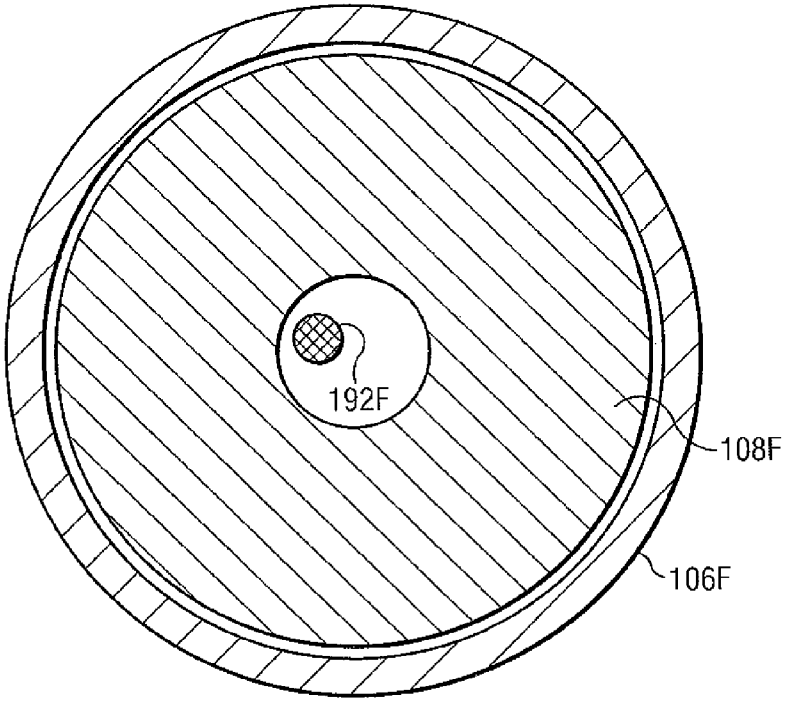
FIGS. 15E and 15F are cross sections respectively taken along lines 15E-15E and lines 15F-15F of FIG. 14.
Figure 15F:
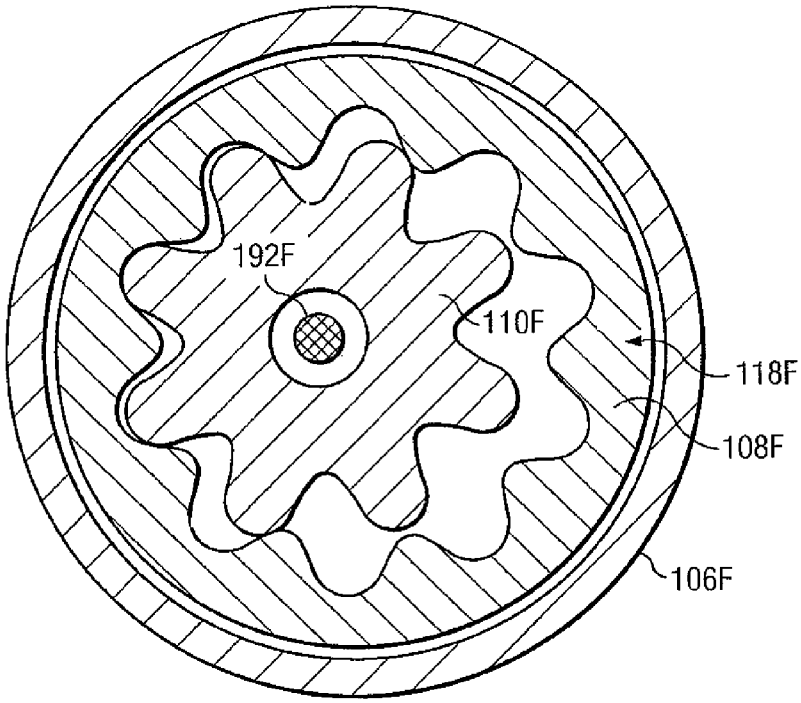

FIGS. 15E and 15F are cross sections respectively taken along lines 15E-15E and lines 15F-15F of FIG. 14. FIGS. 15E and 15F show the housing 106F, the shaft 192F, and the outer gerotor 108F. FIG. 15F also shows the inner gerotor 110F and further details of the synchronizing mechanism 118F. The synchronizing mechanism 118F of FIG. 15F is a trochoidal gear arrangement between the inner gerotor 110F and the outer gerotor 108F. The synchronizing mechanism 118F in other embodiments may include involute gears, peg-and-cam systems, or other suitable synchronizing systems.

Figure 15G:
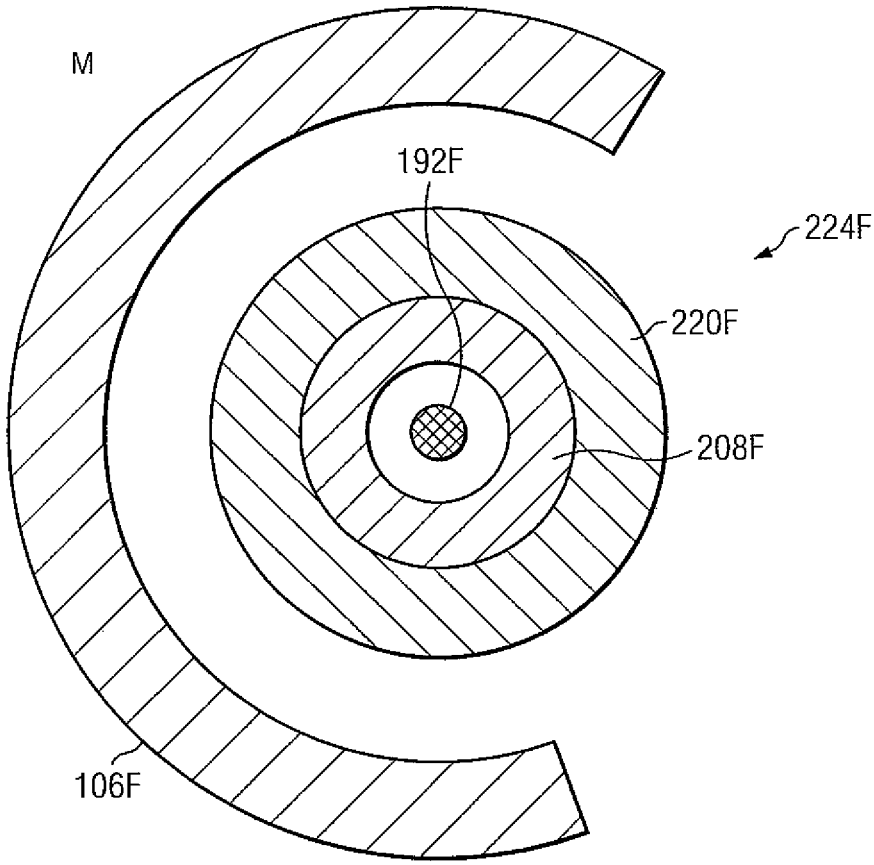
FIG. 15G is a cross section taken along line 15G-15G of FIG. 14.

FIG. 15G is a cross section taken along lines 15G-15G of FIG. 14. FIG. 15G shows the housing 106F, shaft 192F, the outer gerotor, pulley system 220F, and power port 224F.

Figure 16:
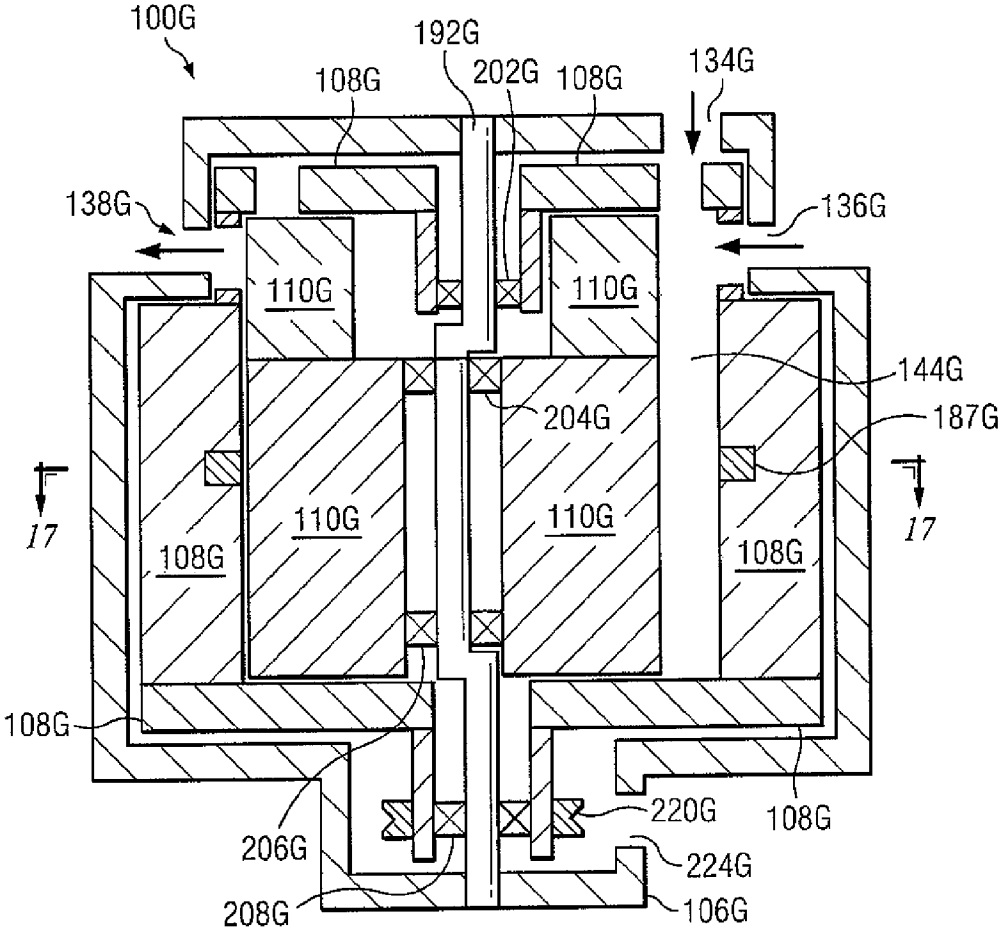
FIG. 16 is a side cross-sectional view of an engine system, according to another embodiment of the invention.

FIG. 16 is a side cross-sectional view of an engine system 100G, according to another embodiment of the invention. The engine system 100G of FIG. 16 may include features similar to the engine system 100F of FIG. 15, including a housing 106G, an outer gerotor 108G, an outer gerotor chamber 144G, an inner gerotor 110G, a stationary shaft 192G, a tip inlet port 136G, a face inlet port 132G, a tip outlet port 138G, a pulley system 220G, a power port 224F, and bearings 202F, 204F, 206F, and 208F. And, similar to engine system 100F, the engine system 100G in various embodiments may include more, fewer, or different component parts, including but not limited the components from various configurations described herein with reference to other embodiments. The engine system 100G of FIG. 16 may be designed as a compressor, expander, or both, depending on the embodiment or intended application. For purposes of illustration, the engine system 100G is shown as a compressor.

The embodiment of the engine system 100G of FIG. 16 differs from the embodiment of the engine system 100F, described herein, in that the outer gerotor 108G directly drives the inner gerotor 110G using a strip of low-friction material 187G. Further details of this direct drive are provided below with reference to FIG. 17.

Figure 17:
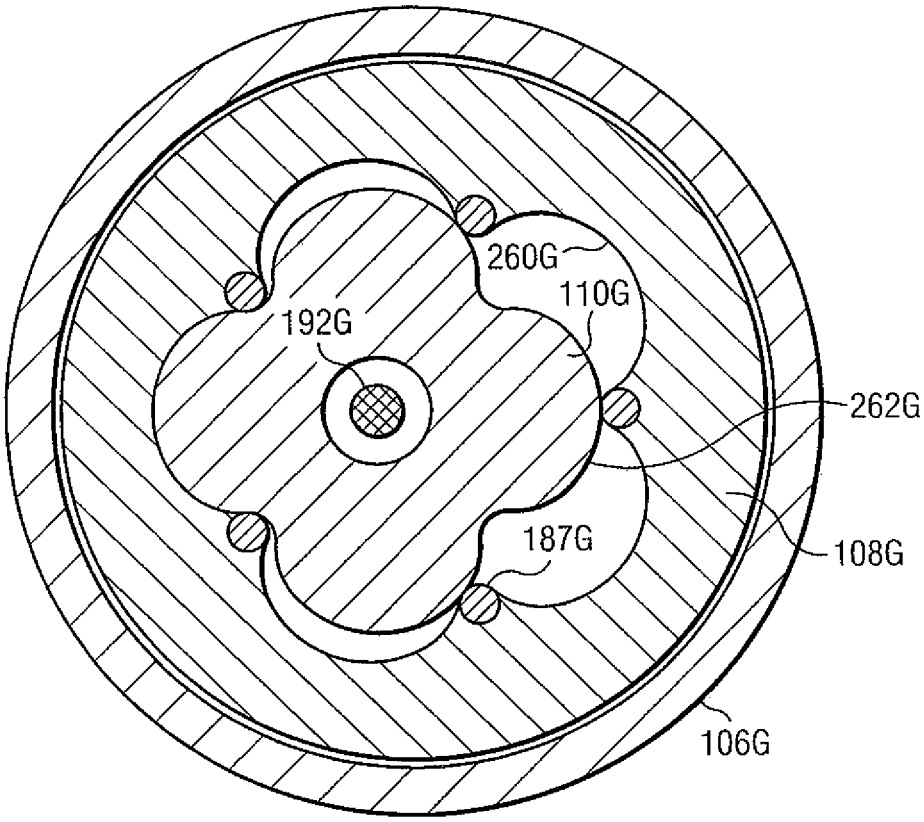
FIG. 17 is a cross section taken along line 17-17 of FIG. 16.

FIG. 17 is a cross section taken along lines 17-17 of FIG. 16. FIG. 17 shows the housing 106G, the shaft 192G, the outer gerotor 108G, the inner gerotor 110G, and the low-friction material 187G. As the inner gerotor 110G and the outer gerotor 108G rotate relative to one another, at least portions of an outer surface 262G of the inner gerotor 110G contacts at least portions of an inner surface 260G of the outer gerotor 108G, which synchronizes the rotation of the inner gerotor 110G and the outer gerotor 108G. Thus, as shown in FIG. 17, the outer surface 262G of the inner gerotor 110G and the inner surface 260G of the outer gerotor 108G may provide the synchronization function that is provided by separate synchronization mechanisms 118 discussed herein with regard to other embodiments.

In order to reduce friction and wear between the inner gerotor 110G and the outer gerotor 108G, at least a portion of the outer surface 262G of the inner gerotor 110G and/or the inner surface 260G of the outer gerotor 108G is formed from one or more relatively low-friction materials 187G. Such low-friction materials 187G may include, for example, a polymer (phenolics, nylon, polytetrafluoroethylene, acetyl, polyimide, polysulfone, polyphenylene sulfide, ultrahigh-molecular-weight polyethylene), graphite, or oil-impregnated sintered bronze. In some embodiments, such as embodiments in which water is provided as a lubricant between outer surface 187G of inner gerotor 110G and inner surface 260G of outer gerotor 108G, low-friction materials 187G may comprise Vescanite.

Regions for the low-friction materials 187G may include portions (or all) of inner gerotor 110G and/or outer gerotor 108G, or low-friction implants coupled to, or integral with, the inner gerotor 110G and/or the outer gerotor 108G. Depending on the particular embodiment, such regions of the low-friction materials 187G may extend around the inner perimeter of the outer gerotor 108G and/or the outer perimeter of the inner gerotor 110G, or may be located only at particular locations around the inner perimeter of the outer gerotor 108G and/or the outer perimeter of inner gerotor 110G, such as proximate the tips of inner gerotor 110G and/or outer gerotor 108G. As shown in FIG. 17, the low-friction material 187G may be placed on tips of the inner surface 260G of the outer gerotor 108G.

In particular embodiments, the low-friction materials 187G on the inner gerotor 110G and/or the outer gerotor 108G may sufficiently reduce friction and wear such that the gerotor apparatus may be run dry, or without lubrication. However, in some embodiments, a lubricant may be provided to further reduce friction and wear between the inner gerotor 110G and the outer gerotor 108G. The lubricant may include any one or more suitable substances suitable to provide lubrication between multiple surfaces, such as oils, graphite, grease, water, or any other suitable lubricants.

Figure 18:
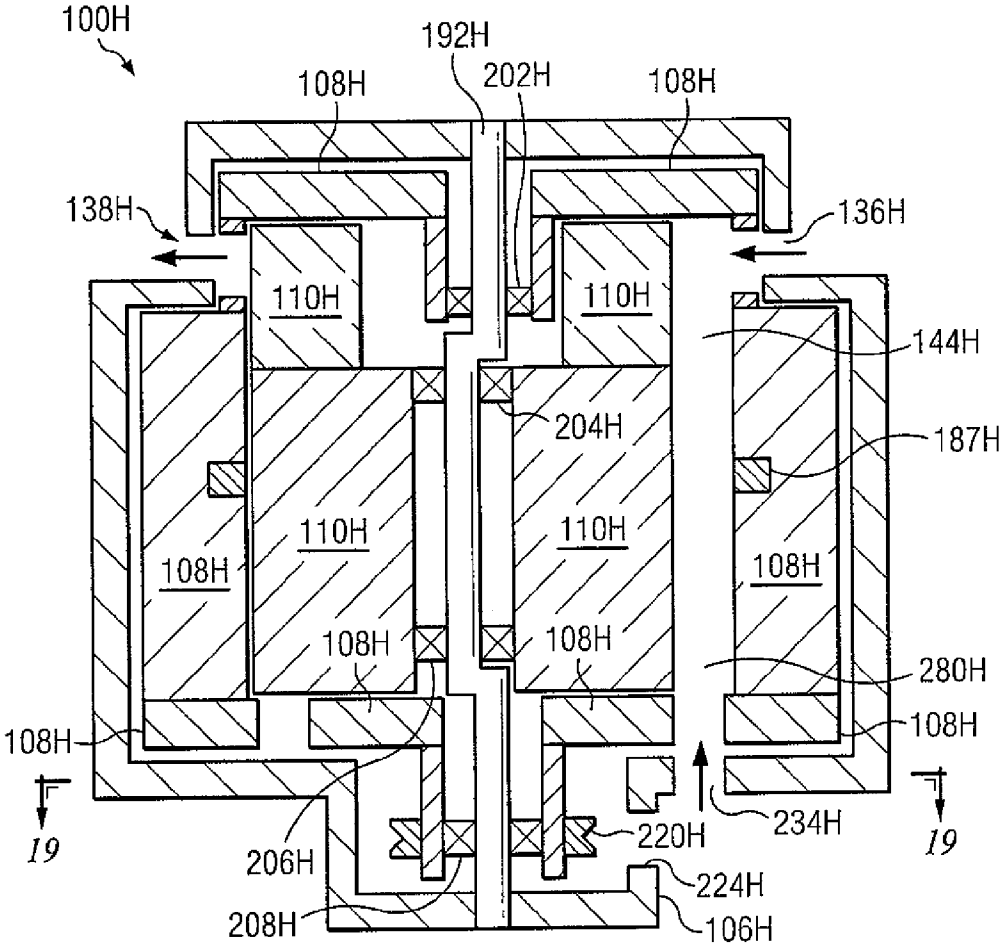
FIG. 18 is a side cross-sectional view of an engine system, according to another embodiment of the invention.

FIG. 18 is a side cross-sectional view of an engine system 100H, according to another embodiment of the invention. The engine system 100H of FIG. 18 may include features similar to the engine system 100G of FIG. 16, including a housing 106H, an outer gerotor 108H, an inner gerotor 110H, an outer gerotor chamber 144H; a stationary shaft 192H, a tip inlet port 136H, a tip outlet port 138H, a direct drive with a low-friction material 187H, a pulley system 220H, a power port 224H, and bearings 202H, 204H, 206H, and 208H. And, similar to engine system 100G, engine system 100H in various embodiments may include more, fewer, or different component parts, including but not limited the components from various configurations described herein with reference to other embodiments. Further, the engine system 100H of FIG. 18 may be designed as a compressor, expander, or both, depending on the embodiment or intended application. For purposes of illustration, the engine system 100H is shown as a compressor. The embodiment of the engine system 100H of FIG. 18 differs from the embodiment of the engine system 100G, described herein, in that in that the engine system 100F includes a bottom face inlet port 234H.

In utilizing the bottom face inlet port 234H at the opposite end from the tip inlet port 136H, the engine system 100H is allowed to be filed from both ends during intake, thereby allowing faster rotational speeds, among other reasons, due to the speed at which fluid travels. This configuration may be contrasted with other configurations in which fluid must travel the length of the engine system to reach, for example, a bottom 280H of engine system 100H.

Figure 19:
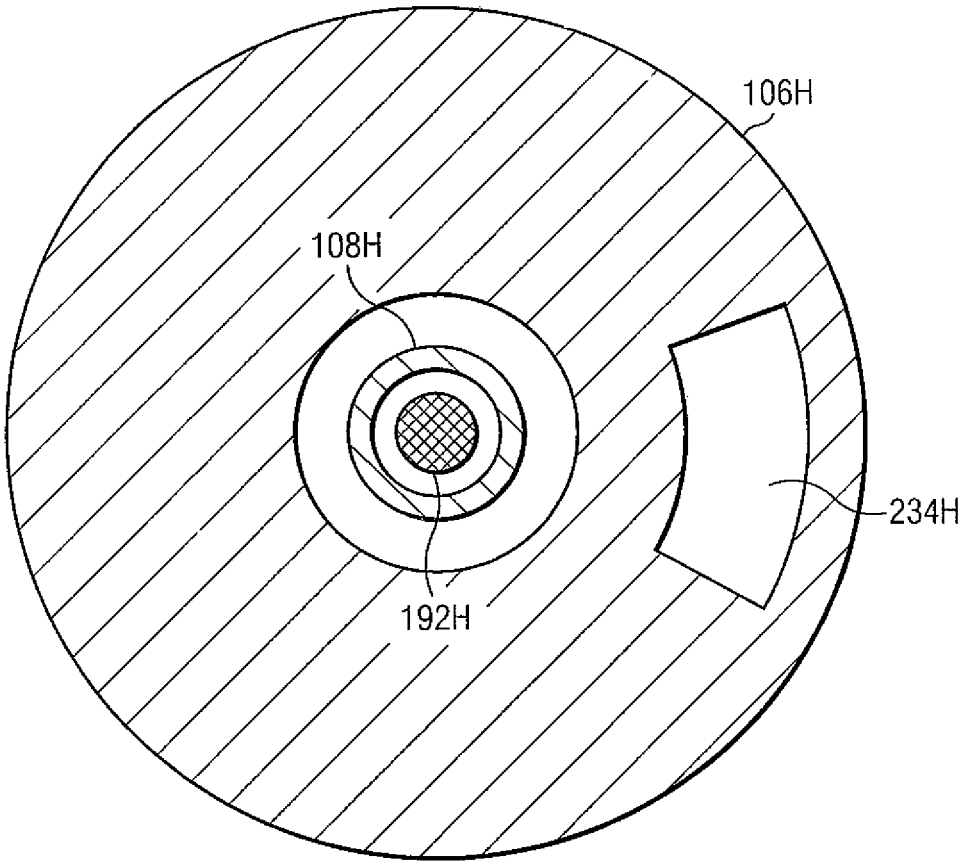
FIG. 19 is a cross section taken along lines 19-19 of FIG. 18.

FIG. 19 is a cross section taken along lines 19-19 of FIG. 18. FIG. 19 shows the housing 106H, the shaft 192B, the inner gerotor 110H, the outer gerotor 108B, and the bottom face inlet port 234H though the housing 106B. Although not shown, the engine system 100H may additionally utilize a configuration similar to the teardrop configurations of FIG. 6B for selective passage of fluid in the intake portion of the cycle. In such embodiments, the teardrop intake would be positioned adjacent the bottom face inlet port 234H.

Figure 20:
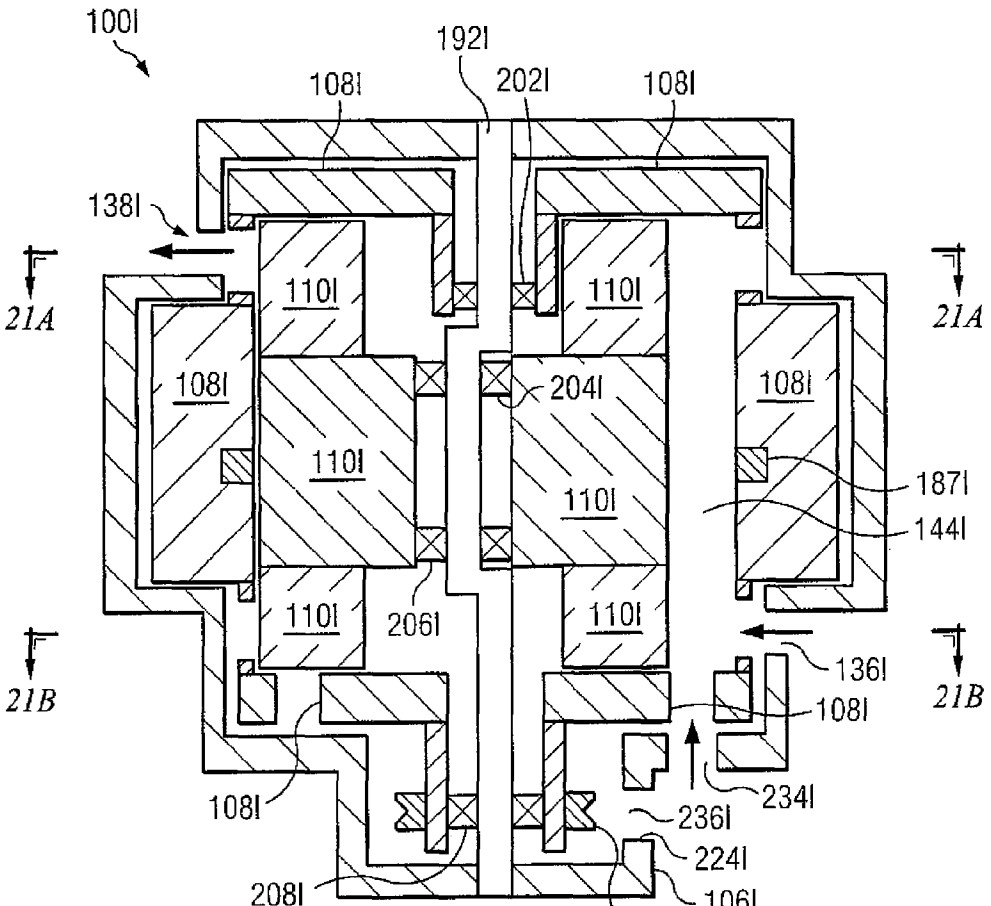
FIG. 20 is a side cross-sectional view of an engine system, according to another embodiment of the invention.

FIG. 20 is a side cross-sectional view of an engine system 100I, according to another embodiment of the invention. The engine system 100I of FIG. 20 may include features similar to the engine system 100G of FIG. 15, including a housing 106I, an outer gerotor 108I, an inner gerotor 110I, outer gerotor chamber 144I, a stationary shaft 192I, a direct drive with a low-friction material 187I, a tip outlet port 138I, a pulley system 220I, a power port 224I, and bearings 202I, 204I, 206I, and 208I. And, similar to the engine system 100G, the engine system 100I in various embodiments may include more, fewer, or different component parts. The embodiment of the engine system 100I of FIG. 20 differs from the embodiment of the engine system 100G, described herein, in that the embodiment of the engine system 100I includes a bottom face inlet port 234I and a bottom tip inlet port 236I. Because the fluid exits from the tip outlet port 138I, the fluid must linear traverse the engine system 100I up through chamber 144I.

Figure 21A:
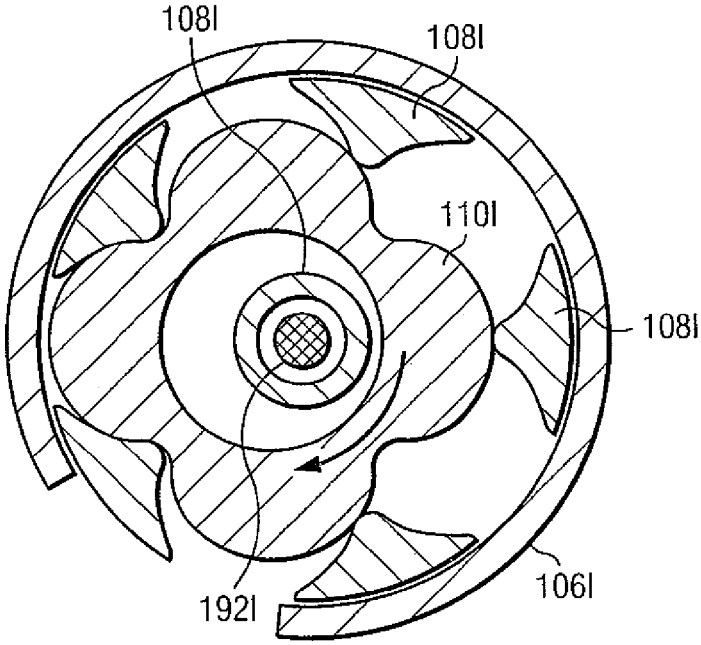
FIGS. 21A and 21B are cross sections respectively taken along line 21A-21A and line 21B-21B of FIG. 20.
Figure 21B:
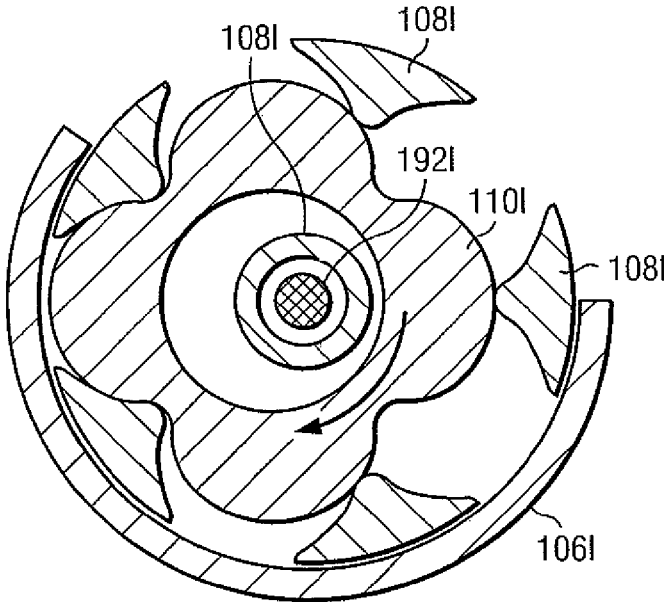

FIGS. 21A and 21B are cross sections respectively taken along line 21A-21A and line 21B-21B of FIG. 20. FIGS. 21A and 21B show the housing 106I, the shaft 192I, the inner gerotor 110I, and the outer gerotor 108.

Figure 22:
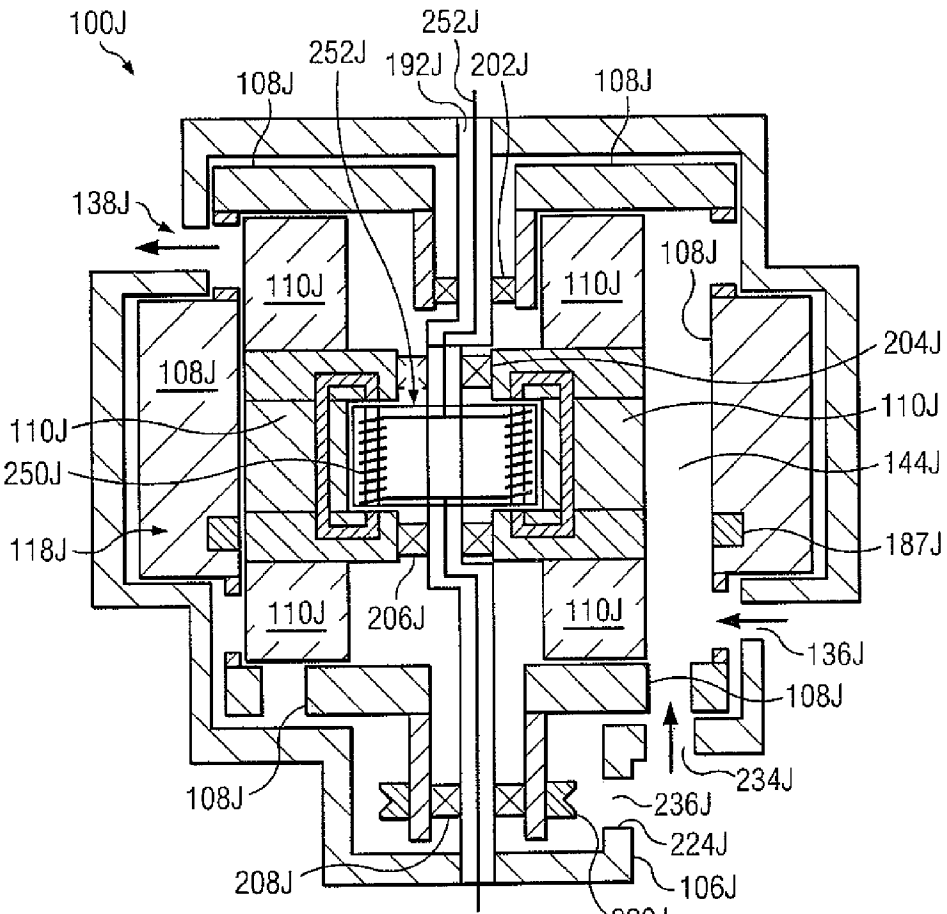
FIG. 22 is a side cross-sectional view of an engine system 100J, according to another embodiment of the invention.

FIG. 22 is a side cross-sectional view of an engine system 100J, according to another embodiment of the invention. The engine system 100J of FIG. 22 may include features similar to the engine system 100I of FIG. 20, including a housing 106J, an outer gerotor chamber 144J, an outer gerotor 108J, an inner gerotor 110J, a stationary shaft 192J, a synchronizing mechanism 118J, a tip outlet port 138J, a pulley system 220J, a power port 224J, bottom face inlet port 234J, a bottom tip inlet port 236J, and bearings 202J, 204J, 206J, and 208J. And, similar to engine system 100I, engine system 100J in various embodiments may include more, fewer, or different component parts. Engine system 100I additionally includes an electrical motor 250J, which receives electrical power through electrical lines 252J. The electrical motor 250J in particular may power the inner rotor 110J. The electric motor may be of a variety of suitable types, such as an induction motor, permanent magnet motor, or switched reluctance motor. In this embodiment, the pulley system 220J may be used to power auxiliary equipment, such as pumps or other devices.

Although specific designs, shapes, and configurations of the inner gerotors and the outer gerotors have be described above with various embodiments, it should be expressly understood that a variety of other designs, shapes, and configurations for the inner gerotors and the outer gerotors may be utilized without departing from the scope of the invention as defined by the claims below.

Furthermore, although the present invention has been described with several embodiments, a myriad of changes, variations, alterations, transformations, and modifications may be suggested to one skilled in the art, and it is intended that the present invention encompass such changes, variations, alterations, transformation, and modifications as they fall within the scope of the appended claims.

What is claimed is:

1. A system, comprising:
a housing; and
an outer gerotor at least partially disposed in the housing and at least partially defining an outer gerotor chamber, wherein:
the housing includes a single movable slider configured to circumferentially move with respect to a circumferential wall of the housing to adjust a ratio of compression or expansion in the outer gerotor chamber,
the single movable slider has a maximum length of circumferential movement, and
the system is configured such that the circumferential movement of the slider over the maximum length does not modify a radial distance between the single movable slider and the circumferential wall of the housing.

2. The system of claim 1, further comprising:
a temperature regulator at least partially disposed in the housing, the temperature regulator configured to regulate a temperature of the housing, the temperature regulator including at least one channel configured to receive a fluid.

3. The system of claim 2, further comprising:
an inner gerotor at least partially disposed within the outer gerotor chamber; and
a seal between the housing and one of the outer gerotor or the inner gerotor, wherein the temperature regulator is configured to thermally expand the housing away from the seal.

4. The system of claim 1, further comprising:
an inner gerotor at least partially disposed within the outer gerotor chamber,
wherein:
the housing further includes a tip outlet port,
the tip outlet port is configured to allow fluid to exit the outer gerotor chamber,
the tip outlet port includes a top portion and a bottom portion,
a first seal is located between the top portion and one of the inner gerotor or the outer gerotor,
a second seal is located between the bottom portion and the one of the inner gerotor or the outer gerotor, and
the top portion and the bottom portion are substantially symmetrical.

5. The system of claim 4, wherein the substantially symmetrical top and bottom portions are operable to balance pressures created by a fluid leak associated with at least one of the first seal or the second seal.

6. The system of claim 1, further comprising:
an inner gerotor at least partially disposed within the outer gerotor chamber; and
a seal between the housing and one of the inner gerotor or the outer gerotor, wherein a thermal datum for the system is substantially in a same plane as the seal.

7. The system of claim 6, further comprising:
at least one bearing substantially in the same plane as the thermal datum.

8. The system of claim 1, further comprising:
an inner gerotor at least partially disposed within the outer gerotor chamber,
wherein:
the system is configured such that an interaction between a portion of one of the inner gerotor or the outer gerotor and a portion of the housing creates a journal bearing, and
the journal bearing includes a gap between the housing and the one of the inner gerotor or the outer gerotor.

9. The system of claim 8, wherein:
the one of the inner gerotor or the outer gerotor includes peripheral portions separated by at least one slot, and
a weight of the peripheral portions centrifugally forces an inner perimeter of the one of the inner gerotor or the outer gerotor to open up when the one of the inner gerotor or the outer gerotor rotates.

10. The system of claim 1, further comprising:
an inner gerotor at least partially disposed within the outer gerotor chamber,
wherein the system is configured to introduce power to an engine system through the inner gerotor.

11. The system of claim 10, wherein:
the system is configured to introduce the power through a rotatable shaft, and
the inner gerotor is rigidly coupled to the rotatable shaft.

12. The system of claim 1, wherein the system is configured to introduce power to an engine system through the outer gerotor.

13. The system of claim 1, further comprising:
an inner gerotor at least partially disposed within the outer gerotor chamber; and
a motor imbedded in the inner gerotor.

14. The system of claim 1, further comprising:

an inner gerotor at least partially disposed within the outer gerotor chamber;

wherein at least a portion of one of the outer gerotor or the inner gerotor comprises a low-friction material.

15. The system of claim 1, further comprising:

an adjustable sealing structure operable to adjustably create a seal between the housing and the outer gerotor.

16. The system of claim 15, wherein:

the outer gerotor includes at least one strengthening band, the adjustable sealing structure is configured to receive the strengthening band, and the seal is located between the housing and the strengthening band.

17. The system of claim 16, wherein:

the adjustable sealing structure includes at least one groove having a gap configured to receive the strengthening band, the at least one groove includes a first seat disposed on one side of the gap and a second seat disposed on a second side of the gap, at least one of the first seat or the second seat is actuatable towards another of the first seat or the second seat to reduce the gap, and the system is configured such that the actuation of at least one of the first seat or the second seat forces the first seat and the second seats against the strengthening band.

18. The system of claim 17, wherein at least one of the first seat or the second seat includes tubing that is configured to receive fluid to actuate towards the other of the first seat or the second seat.

19. The system of claim 1, wherein:

the outer gerotor includes at least one gerotor chamber face inlet port that is configured to rotate with the outer gerotor, and the at least one gerotor chamber face inlet port is configured to be opened during an intake of fluids into the outer gerotor chamber and to be closed during an exhaust of fluids out of the outer gerotor chamber.

20. The system of claim 19, further comprising:

an inner gerotor at least partially disposed within the outer gerotor chamber, wherein:

the at least one gerotor chamber face inlet port is in fluid communication with a face inlet port of the housing and the outer gerotor chamber during the intake of fluids into the outer gerotor chamber, and the at least one gerotor chamber face inlet port is blocked on one side by the housing and on another side by the inner gerotor during the exhaust of fluids out of the outer gerotor chamber.

21. The system of claim 1, further comprising:

an inner gerotor at least partially disposed within the outer gerotor chamber.

22. The system of claim 1, wherein the single movable slider is configured to provide a different ratio of compression or a different ratio of expansion at each location along the maximum length of circumferential movement.

23. The system of claim 1, wherein the system is configured such that movement of the single movable slider alone adjusts the ratio of compression in the outer gerotor chamber.

24. The system of claim 1, wherein the system is configured such that the movement of the movable slider does not introduce dead space into the system.

25. A system, comprising:

a housing; and an outer gerotor at least partially disposed in the housing and at least partially defining an outer gerotor chamber, wherein:

the housing includes a single movable slider configured to adjust a ratio of compression or expansion in the outer gerotor chamber by modifying a compression or expansion area in the outer gerotor chamber, the single movable slider has a maximum length of circumferential movement with respect to a circumferential wall of the housing, and the system is configured such that the circumferential movement of the slider over the maximum length does not modify a radial distance between the single movable slider and the circumferential wall of the housing.

26. The system of claim 25, further comprising:

an inner gerotor at least partially disposed within the outer gerotor chamber.

27. A system, comprising:

a housing; and an outer gerotor at least partially disposed in the housing and at least partially defining an outer gerotor chamber, wherein:

the housing includes a movable slider configured to adjust a ratio of compression or expansion in the outer gerotor chamber by modifying a compression or expansion area in the outer gerotor chamber, the single movable slider has a maximum length of circumferential movement with respect to a circumferential wall of the housing, and the single movable slider is configured to provide a different ratio of compression or a different ratio of expansion at each location along the maximum length of circumferential movement.

28. The system of claim 27, further comprising:

an inner gerotor at least partially disposed within the outer gerotor chamber.

* * * * *